US010344468B2

(12) United States Patent
Yin et al.

(10) Patent No.: US 10,344,468 B2
(45) Date of Patent: Jul. 9, 2019

(54) STRUCTURE OF LOAD-BEARING COLUMNS AND FACTORY USING THE SAME

(71) Applicant: RUENTEX ENGINEERING & CONSTRUCTION CO., LTD., Taipei (TW)

(72) Inventors: Samuel Yin, Taipei (TW); Pin-Pin Teng, Taipei (TW); Chang-Sheng Tsao, Taipei (TW)

(73) Assignee: RUENTEX ENGINEERING & CONSTRUCTION, CO., LTD., Taipei (TW)

( * ) Notice: Subject to any disclaimer, the term of this patent is extended or adjusted under 35 U.S.C. 154(b) by 0 days.

(21) Appl. No.: 15/840,058

(22) Filed: Dec. 13, 2017

(65) Prior Publication Data

US 2019/0078316 A1 Mar. 14, 2019

(30) Foreign Application Priority Data

Sep. 14, 2017 (TW) ..... 106131532 A

(51) Int. Cl.

| | |
|---|---|
| ***E04C 3/00*** | (2006.01) |
| ***E04B 1/30*** | (2006.01) |
| ***E04C 3/34*** | (2006.01) |
| ***E04B 1/21*** | (2006.01) |
| ***E04C 3/32*** | (2006.01) |
| ***E04B 1/24*** | (2006.01) |

(Continued)

(52) U.S. Cl.

CPC ..... *E04B 1/30* (2013.01); *E04B 1/21* (2013.01); *E04B 1/24* (2013.01); *E04C 3/32* (2013.01); *E04C 3/34* (2013.01); *E04C 5/0609* (2013.01); *E04C 5/0618* (2013.01); *E04B 2001/2478* (2013.01); *E04B 2103/02* (2013.01); *E04B 2103/06* (2013.01); *E04C 5/165* (2013.01)

(58) Field of Classification Search

CPC .... E04B 1/30; E04B 2103/02; E04B 2103/06; E04C 2/32; E04C 2/34; E04C 3/34

USPC ..... 52/79.1, 236.3

See application file for complete search history.

(56) References Cited

U.S. PATENT DOCUMENTS 960,125 A * 5/1910 Tresidder ..... E04B 1/185 52/283

3,938,294 A * 2/1976 Gaburri ..... E04B 1/30 52/742.14

(Continued)

FOREIGN PATENT DOCUMENTS

CA 2308800 A1 * 5/1999 ..... E04C 5/06

*Primary Examiner* — Beth A Stephan

(74) *Attorney, Agent, or Firm* — Juan Carlos A. Marquez; Marquez IP Law Office, PLLC

(57) ABSTRACT

The present application relates to the structure of a load-bearing column and a factory using the same. The load-bearing columns comprise a first column, a second column and a third column. The first column is a reinforced concrete column and is arranged on the underground floor. The second column is a pre-fabricated reinforced concrete column on the ground floor and is fixed to the top of the first column. The third column is fixed to the top of the second column, wherein the third column comprises a steel column and a third reinforcing bar assembly which surrounds the circumference of the steel column and extends from the bottom of the steel column in an axial direction to a predetermined distance.

21 Claims, 26 Drawing Sheets

(51) Int. Cl.
*E04C 5/06* (2006.01)
*E04C 5/16* (2006.01)

(56) References Cited

U.S. PATENT DOCUMENTS 5,012,622 A * 5/1991 Sato ..... E02D 5/30 52/263
2003/0097806 A1* 5/2003 Brown ..... E04B 5/026 52/220.1
2008/0060293 A1* 3/2008 Hanlon ..... E04B 1/20 52/251
2010/0071315 A1* 3/2010 Hong ..... E04B 1/215 52/848
2012/0233936 A1* 9/2012 Zhong ..... E04B 1/165 52/173.1
2014/0305070 A1* 10/2014 Jin ..... E04G 11/28 52/742.14
2014/0373471 A1* 12/2014 Knepp ..... E04C 3/005 52/296

* cited by examiner

STRUCTURE OF LOAD-BEARING COLUMNS AND FACTORY USING THE SAME

BACKGROUND

Field of the Invention

The instant disclosure relates to the structure of a load-bearing column and a factory using the same, more particularly, to the structure of a load-bearing column used in a factory with a waffle slab and a factory with a waffle slab using the same.

Description of Related Art

High-tech products, such as chips, wafers or computer components, are becoming ever more sophisticated and requiring increasingly precise work. Therefore, clean rooms are used for keeping the production line free of contaminants that might otherwise interfere with the precision work undertaken. Waffle slabs are typically used as the floor of a clean room of a high-tech factory. A clean room is designed to maintain positive pressure such that air with contaminants is exhausted via the holes provided in the waffle slabs. The contaminated air is then filtered and returned into the clean room. Normally, there are urgent time constraints associated with construction of a high-tech factory, and thus steel construction (SC) or steel reinforced concrete (SRC) is often used as the load-bearing column of the such factory because using it can substantially reduce manpower required for pouring concrete and shorten the time it takes to complete construction.

However, since SC and SRC require a great amount of steel, which is expensive compared to other construction materials, comprehensive use of SC or SRC for load-bearing columns will result in high construction cost. Hence, there is a need in the field to develop a novel structure of load-bearing columns and a factory using the same that can lower construction cost and shorten construction time while still achieving the required structural strength.

SUMMARY OF THE INVENTION

According to a first aspect of the instant disclosure, a load-bearing column comprises a first column, a second column and a third column. The first column is a reinforced concrete column and is arranged on the underground floor. The second column is a pre-fabricated reinforced concrete column on the ground floor and is fixed to the top of the first column. The third column is fixed to the top of the second column. The third column comprises a steel column and a third reinforcing bar assembly which surrounds the circumference of the steel column and extends from the bottom of the steel column in an axial direction to a predetermined distance.

According to a second aspect of the instant disclosure, a factory comprises a plurality of first load-bearing columns according to the first aspect, wherein waffle slabs are horizontally provided between the plurality of first load-bearing columns at a level around where the second column connects with the third column.

According to a third aspect of the instant disclosure, a factory comprises a plurality of second load-bearing columns according to the first aspect, wherein waffle slabs are horizontally provided between the plurality of second load-bearing columns at a level around the predetermined distance from the bottom of the third column of the plurality of second load-bearing columns.

According to a fourth aspect of the instant disclosure, a factory has first load-bearing columns and second load-bearing columns according to the first aspect, wherein a first position is defined as around where the second column connects with the third column of the first load-bearing column, and a second position is defined as around where the predetermined distance from the bottom of third column of the second load-bearing column, and waffle slabs are provided horizontally between the first position and the second position.

In order to further understand the instant disclosure, the following embodiments are provided along with illustrations to facilitate appreciation of the instant disclosure; however, the appended drawings are merely provided for reference and illustration and are not intended to be used for limiting the scope of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

Figure 1:
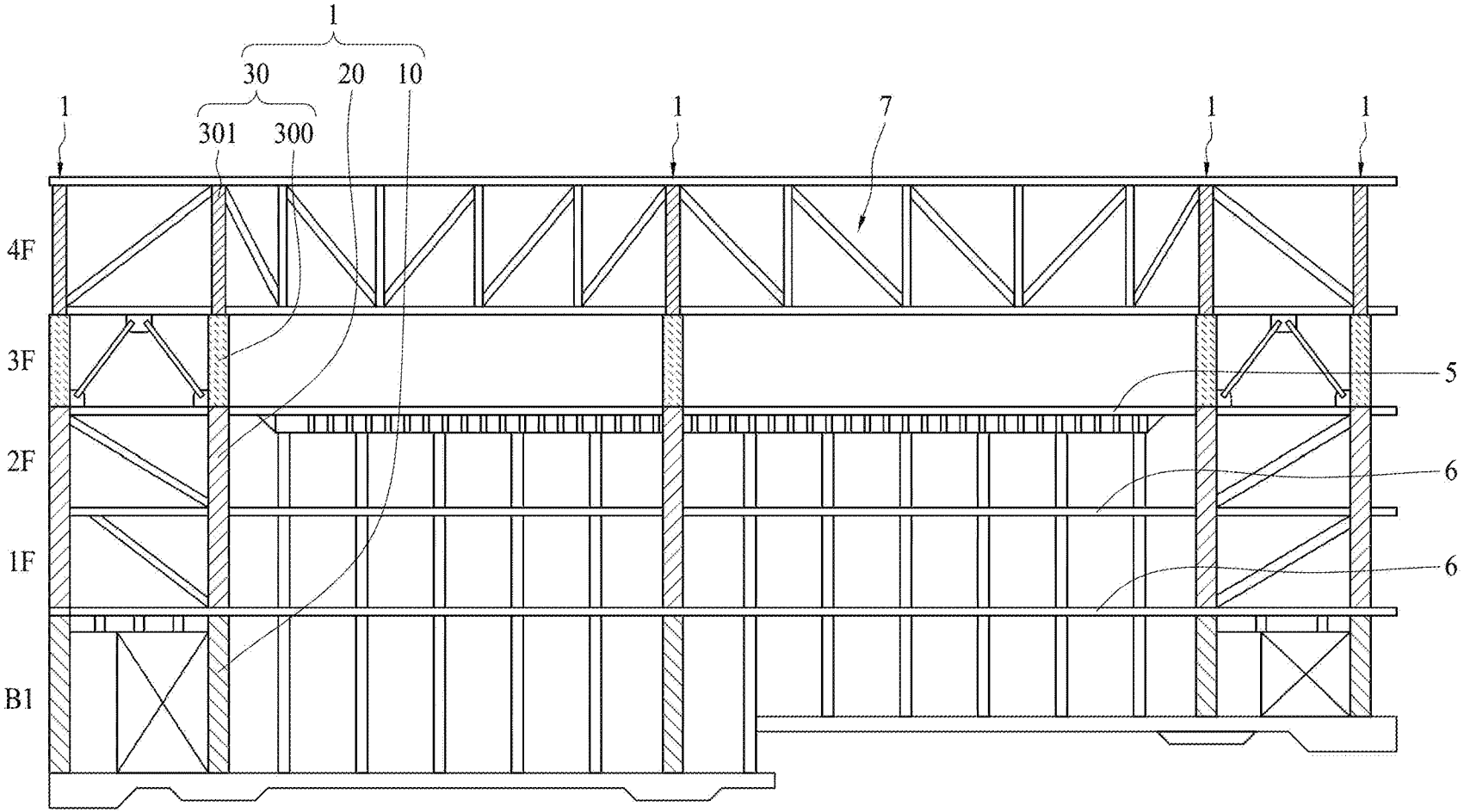
FIG. 1 is a plan schematic view showing the structure of a factory with first load-bearing columns.

Please refer to FIG. 1. FIG. 1 is a plan schematic view showing the structure of a factory with first load-bearing columns 1, which illustrates a four-floor factory or dust-free factory. The structure of the factory comprises first load-bearing columns 1, waffle slabs 5, floorslabs 6 and trusses 7. The first load-bearing column 1 comprises a first column 10, a second column 20 and a third column 30.

The first column 10 is arranged on an underground floor (BI) as a support of the load-bearing column. In an embodiment of the instant disclosure, the first column 10 is a reinforced concrete column, which is molded and grouted at the construction site. In another embodiment of the instant disclosure, the first column 10 is a pre-fabricated reinforced concrete column, which is molded and grouted in the pre-fabricated factory and then transported to the site for construction.

The second column 20 is arranged on a ground floor and is fixed to the top of the first column 10. In an embodiment of the instant disclosure, the second column 20 is about a normal two-floor height. The second column 20 extends upward from the bottom of the first floor (1F) through the entire first floor (1F) and second floor (2F) of the factory. In one embodiment of this disclosure, the second column 20 is a pre-fabricated reinforced concrete column. According to structural technicians, for the purpose of building a factory, the structural strength of the second column 20 where it is a pre-fabricated reinforced concrete column is almost the same as where it is steel reinforced concrete column. However, the pre-fabricated reinforced concrete column can save the amount of steel required by up to 40-50% compared to a steel reinforced concrete column, and thus has the benefit of lowering construction cost.

The third column 30 is fixed to the top of the second column 20. The third column 30 comprises a steel column 301 and a third reinforcing bar assembly 300 which surrounds the steel column 301 to form a steel reinforced concrete structure after grouting. The third reinforcing bar assembly 300 surrounds a circumference of the steel column 301 and extends from the bottom end of the steel column 301 in an axial direction to a predetermined distance (or height). In an embodiment of the instant disclosure, the third column 30 is about two-floor height. The third column 30 extends from the bottom of the third floor (3F) through the entire third floor (3F) and fourth floor (4F). The predetermined distance is about one-floor height in this embodiment.

Waffle slabs 5 are horizontally provided between the plurality of first load-bearing columns 1 at around the level where the second column 20 connects with the third column 30. In an embodiment of the instant disclosure, the waffle slabs 5 are provided between around the second floor and the third floor. In the embodiment shown in FIG. 1, the third floor is used as flooring for a clean room, the contaminated air is exhausted downward from the clean room via the holes (not shown) provided in the waffle slabs 5, and then the contaminated air is filtered and returned into the clean room.

As shown in FIG. 1, trusses 7 are located at the floor where the steel column 301 is not surrounded by the third reinforcing bar assembly 300. In an embodiment of the instant disclosure, the trusses 7 are located at the fourth floor (4F). In addition to the waffle slabs 5 and the trusses 7, floorslabs 6 are provided at other floors in the factory.

Figure 2:
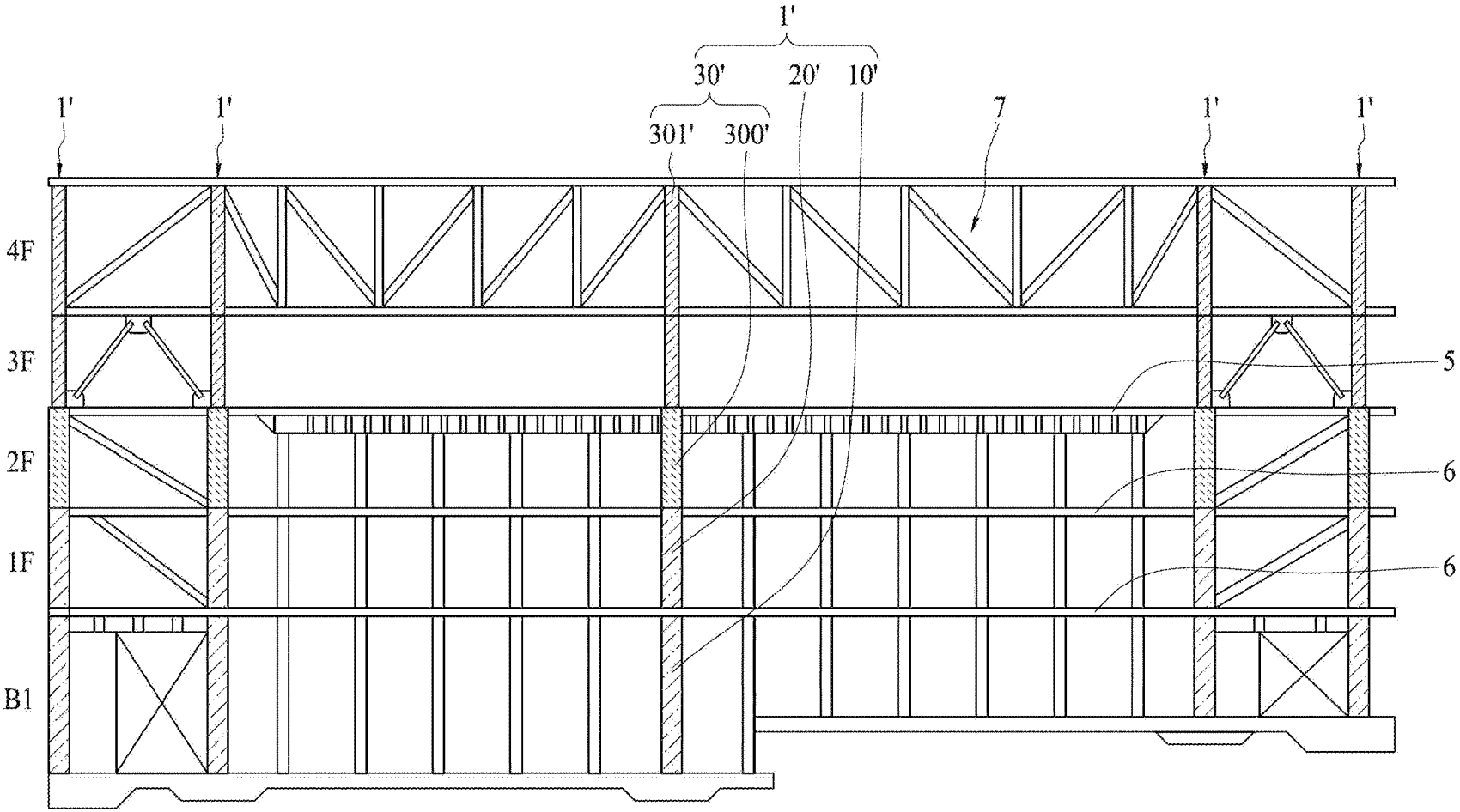
FIG. 2 is a plan schematic view showing the structure of the factory with second load-bearing columns.

Please refer to FIG. 2. FIG. 2 is a plan schematic view showing the structure of the factory with second load-bearing columns 1', which illustrates a four-floor factory or dust-free factory. The structure of the factory comprises second load-bearing columns 1', waffle slabs 5, floorslabs 6 and trusses 7. The second load-bearing column 1' comprises a first column 10', a second column 20' and a third column 30'.

The first column 10' is arranged on an underground floor (BI) for supporting the load-bearing column 1' to the ground. In an embodiment of the instant disclosure, the first column 10' is a reinforced concrete column, which is molded and grouted at the construction site. In another embodiment of the instant disclosure, the first column 10' is a pre-fabricated reinforced concrete column, which is molded and grouted in the pre-fabricated factory and then transported to the site for construction.

The second column 20' is arranged on a ground floor (1F) and is fixed to the top of the first column 10'. In an embodiment of the instant disclosure, the second column 20' is about one-floor height, which is the height of the first floor in this embodiment. According to structural technicians, no matter whether the second column 20 is made of pre-fabricated reinforced concrete or steel reinforced concrete, they both provide sufficient structural strength. However, in this embodiment, the pre-fabricated reinforced concrete column can save the amount of steel, one of the most expensive construction materials, by up to 30-40% compared to a steel reinforced concrete column.

The third column 30' is fixed to the top of the second column 20'. The third column 30' comprises a steel column 301' and a third reinforcing bar assembly 300' which surrounds the steel column 301' to form a steel reinforced concrete structure after grouting. The third reinforcing bar assembly 300' surrounds a circumference of the steel column 301' and extends from the bottom end of the steel column 301' in an axial direction to a predetermined distance (or height). In this embodiment, the third column 30' is about three-floor height, which is the total height of the second floor, third floor and the fourth floor. The predetermined distance is about one-floor height.

Waffle slabs 5 are horizontally provided between the plurality of second load-bearing columns 1' at the level of the predetermined distance from the bottom of the third column 30', wherein the predetermined distance is the dimension in which the third reinforcing bar assembly 300' surrounds the steel column 301' in the axial direction. In an embodiment of the instant disclosure, the predetermined distance is approximately one-floor height, and the waffle slabs 5 are provided between the second floor and the third floor.

Trusses 7 are located at the upper portion of the steel column 301' where the third reinforcing bar assembly is not grouted by concrete. In an embodiment of the to instant disclosure, the trusses 7 are located at the fourth floor (4F). In addition to the waffle slabs 5 and the truss 7, floorslabs 6 are provided at other floors in the factory.

Figure 3:
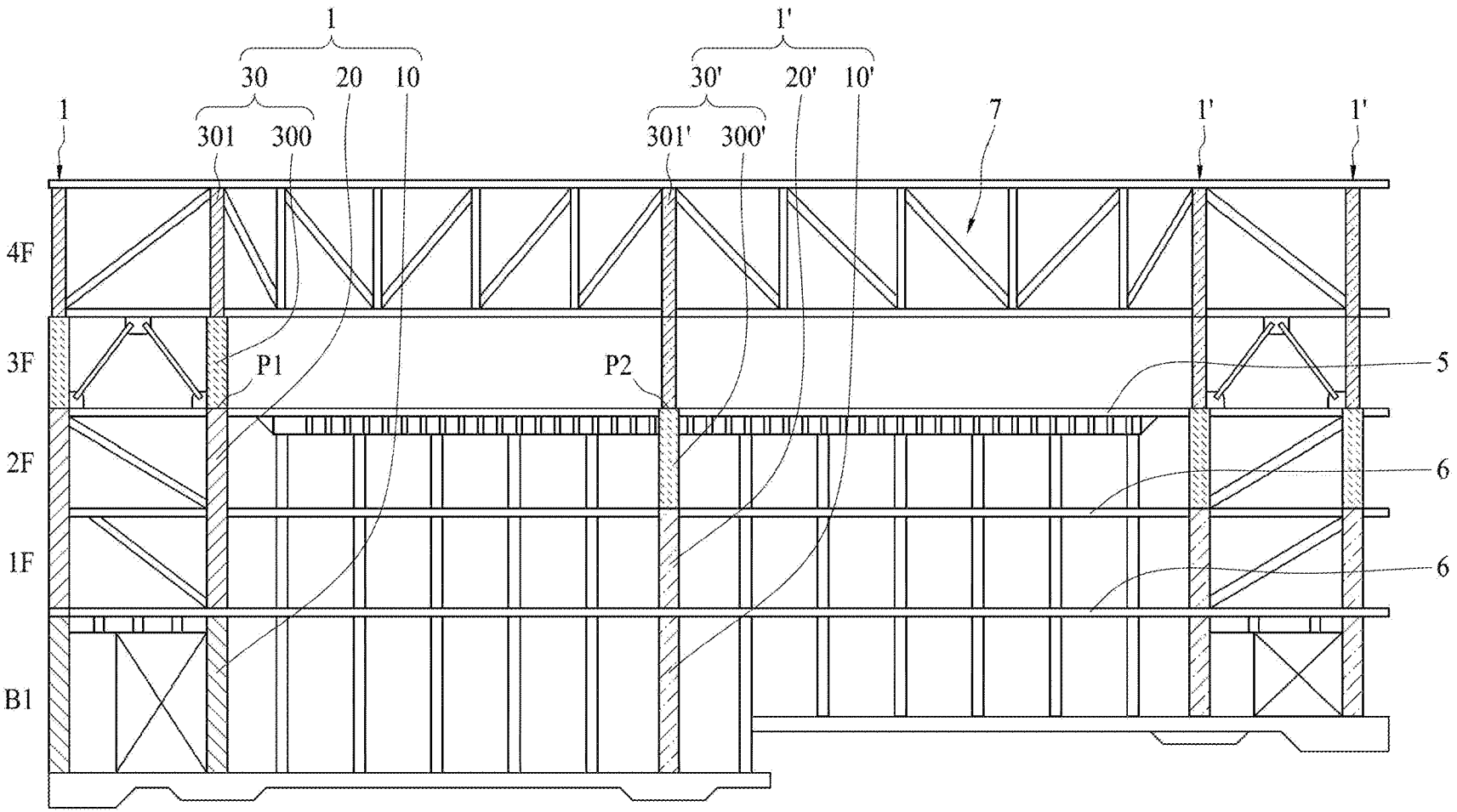
FIG. 3 is a plan schematic view showing the structure of the factory with first load-bearing columns and second load-bearing columns.

Please refer to FIG. 3. FIG. 3 is a plan schematic view showing the structure of the factory with first load-bearing columns 1 and second load-bearing columns 1', which illustrates a four-floor factory or dust-free factory. The structure of the factory comprises first load-bearing columns 1, second load-bearing columns 1', waffle slabs 5, floorslabs 6 and trusses 7.

The first load-bearing column 1 comprises a first column 10, a second column 20 and a third column 30, and is described in the above. The second load-bearing column 1' comprises a first column 10', a second column 20' and a third column structure 30', and is also described in the above.

A first position P1 is defined as where the second column 20 connects with the third column 30 in the first load-bearing column 1. A second position P2 is upward distanced from the bottom of the third column of the second load-bearing column 1' by the predetermined distance. The predetermined distance is the dimension in which the third reinforcing bar assembly 300' surrounds the steel column 301' in the axial direction. The waffle slabs 5 are horizontally provided between the first position P1 and the second position P2. That is, the first position P1 of the first load-bearing column 1 is about the same level as that of the second position P2 of the second load-bearing column 1'. In an embodiment of the instant disclosure, the predetermined distance is approximately one-floor height, the first position P1 and the second position P2 are located between the second floor and the third floor, and the waffle slabs 5 are provided between the second floor and the third floor.

Trusses 7 are located between the first load-bearing columns 1 where the third column 30' is not grouted by concrete and the second load-bearing columns 1' where the upper portion of the third column 30' is not grouted by concrete. In an embodiment of the instant disclosure, trusses 7 are located at the fourth floor. In addition to the waffle slabs 5 and trusses 7, floorslabs 6 are provided at other floors in the factory.

Figure 4A:
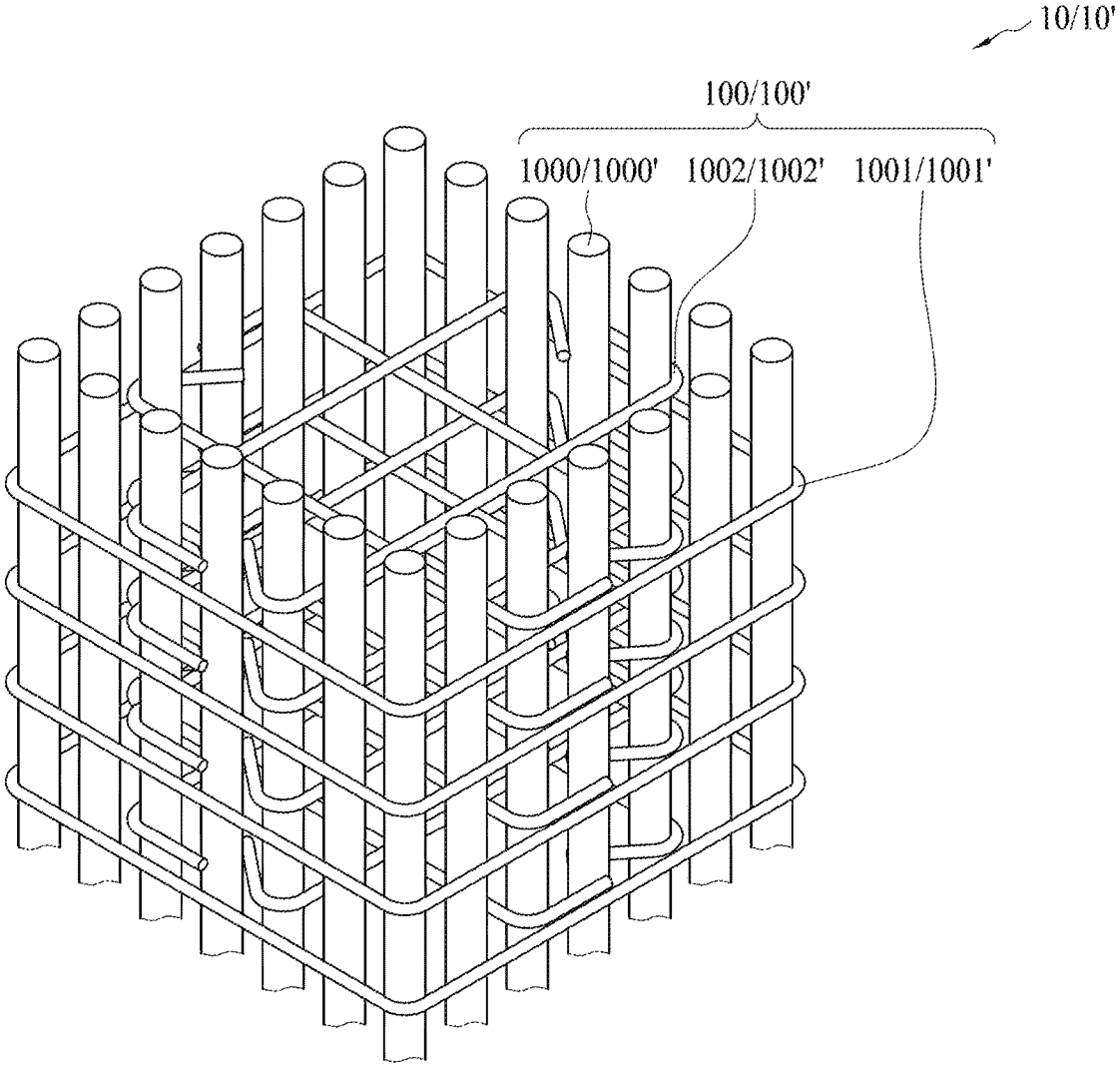
FIG. 4A is a perspective schematic view showing the structure of a steel cage used in a first column in accordance with one embodiment of the instant disclosure.
Figure 4B:
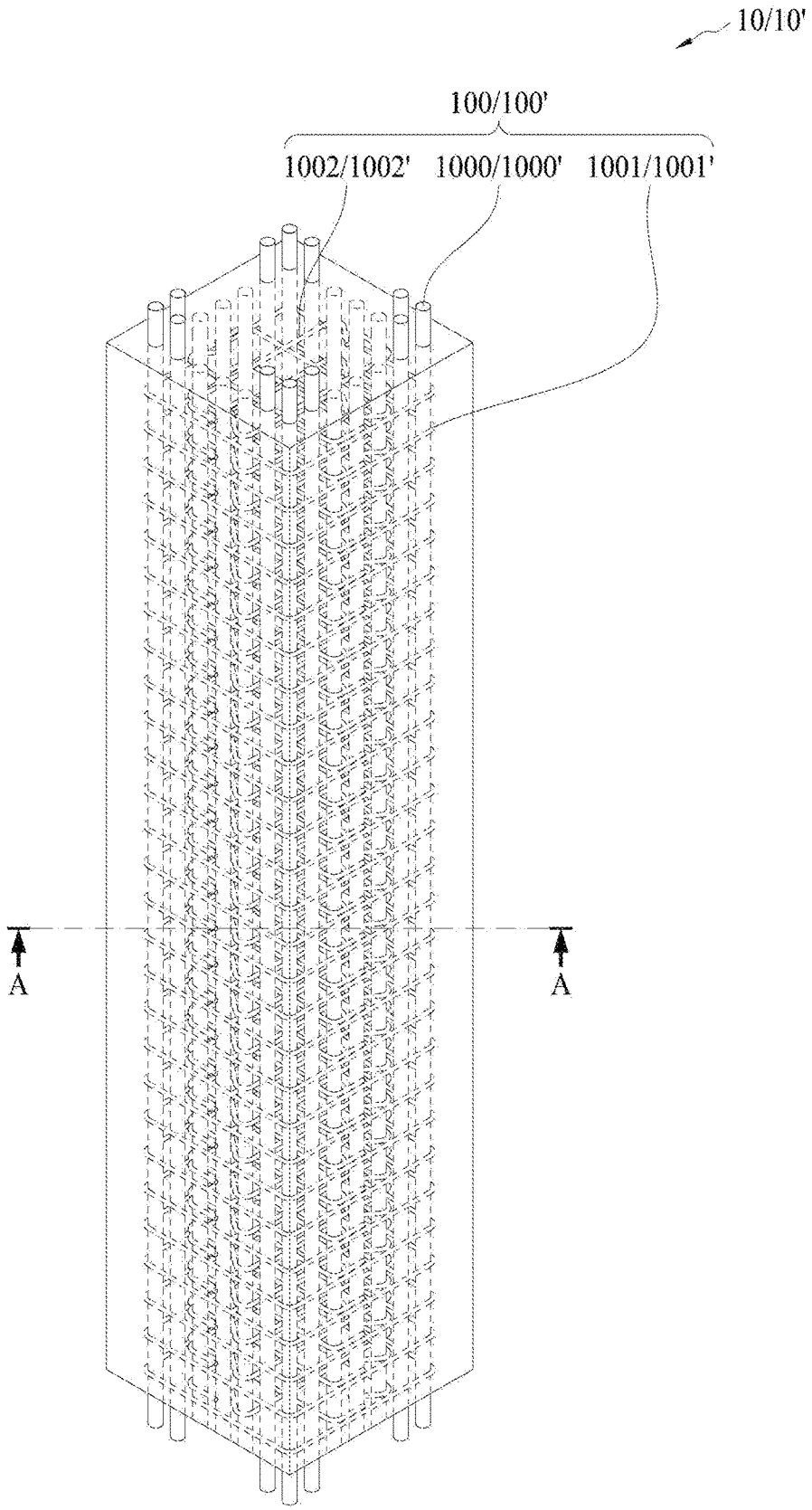
FIG. 4B is a perspective schematic view showing the structure of the first column with hardened reinforced concrete in accordance with one embodiment of the instant disclosure.
Figure 4C:
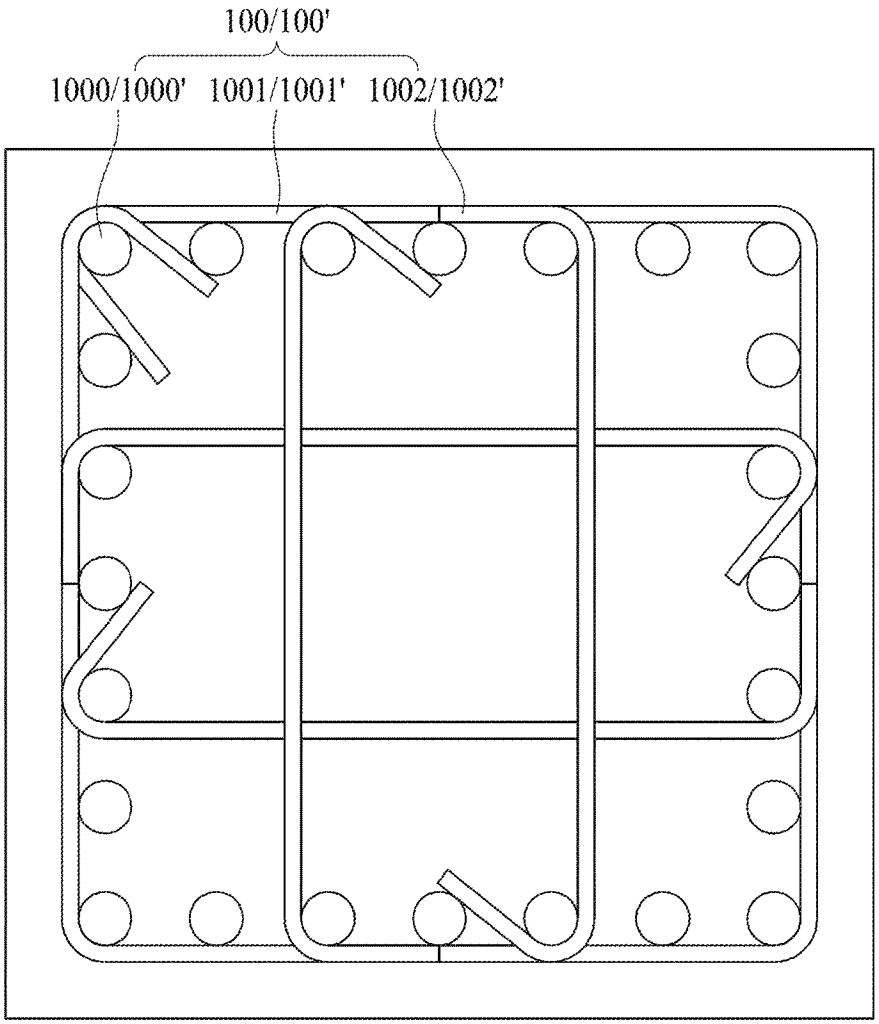
FIG. 4C is a cross-sectional view of FIG. 4B.
Figure 4D:
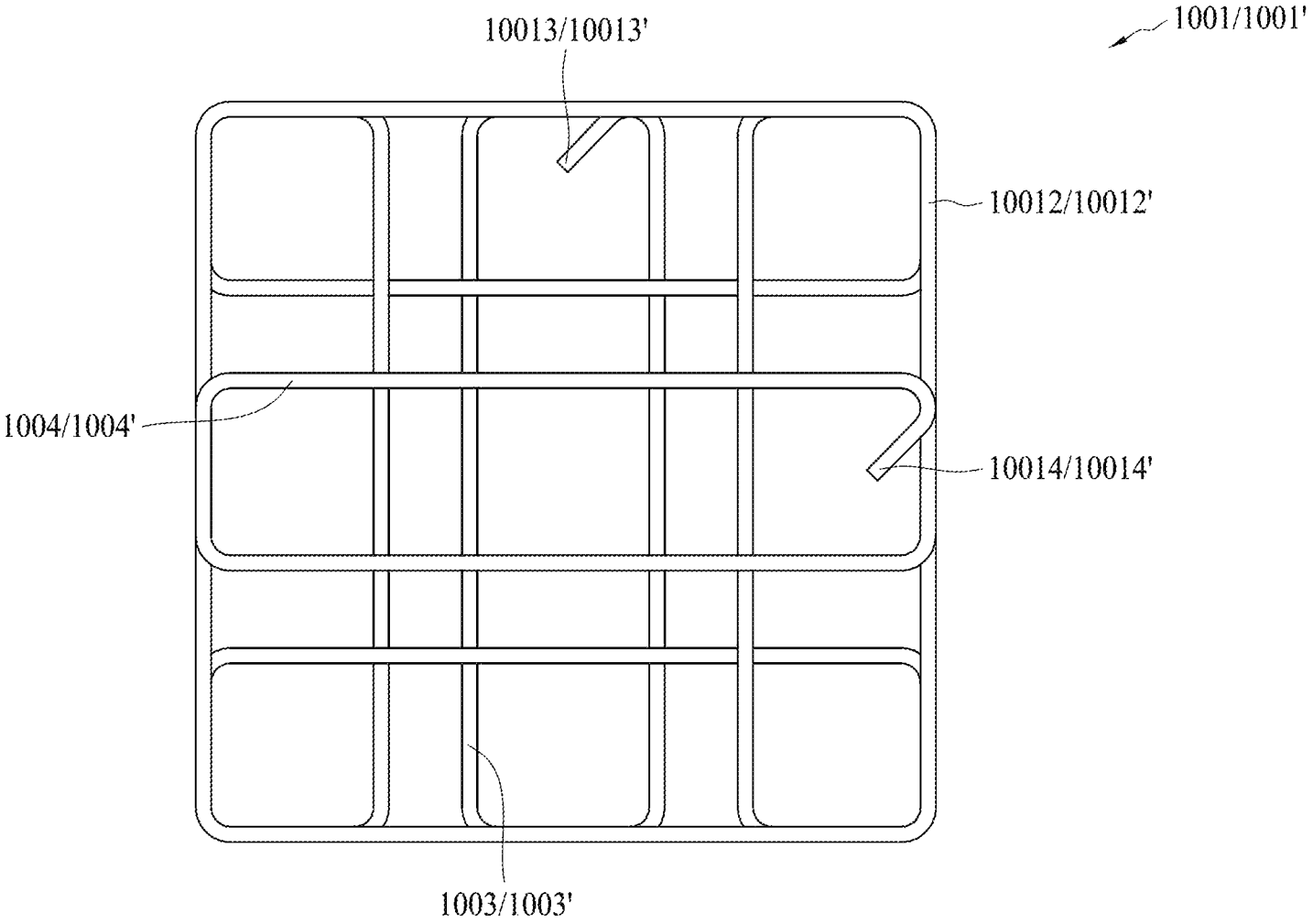
FIG. 4D is a schematic view of a stirrup of a first stirrup assembly that is bent to form a continuous strip-like reinforcing bar.

Please refer to FIGS. 4A-4D. FIG. 4A is a perspective schematic view showing the structure of a steel cage used in a first column 10 (10') in accordance with one embodiment of the instant disclosure. FIG. 4B is a perspective schematic view showing the structure of the first column 10 (10') with the hardened reinforced concrete in accordance with one embodiment of the instant disclosure. FIG. 4C is a cross-sectional view of FIG. 4B. FIG. 4D is a schematic view of a stirrup of a first stirrup assembly 1001 (1001') that is bent to form a continuous strip-like reinforcing bar. The structure of the first column 10 (10') of the first load-bearing column 1 or the second load-bearing column 1' is described below.

As shown in FIGS. 4A-4D, the first column 10 (10') of the first load-bearing column 1 or the second load-bearing column 1' before being formed with concrete comprises a first reinforcing bar assembly 100 (100') which is a steel cage as shown in FIG. 4A. The first reinforcing bar assembly 100 (100') comprises a first main reinforcement assembly 1000 (1000'), a first stirrup assembly 1001 (1001') and a first tie bar assembly 1002 (1002'). The first main reinforcement assembly 1000 (1000') comprises a plurality of main reinforcements arranged parallel to each other at a predetermined distance. The first stirrup assembly 1001 (1001') comprises a plurality of frame-shaped stirrups which enclose the first main reinforcement assembly 1000 (1000') at a predetermined axial distance to reinforce the shear resistance of the first column 10 (10'). The stirrups and main reinforcements are fixed to each other by wires, welding or both.

The first tie bar assembly 1002 (1002') comprises a plurality of tie bars. Each tie bar comprises a first end and a second end, wherein the first end of the tie bar is hooked and secured to a first main reinforcement of the first main reinforcement assembly 1000 (1000'), and the second end of the tie bar is hooked and secured to a second main reinforcement of the first main reinforcement assembly 1000 (1000'), and the first reinforcement corresponds to the second main reinforcement. The first end of the tie bar is bent at least an angle of 90° to 135° and the second end of the tie bar is bent at least an angle of 135° (as shown in FIG. 4C). The first column 10 (10') can be a reinforced concrete column made at a construction site or the pre-fabricated reinforced concrete column. In an embodiment of the instant disclosure, after the first column 10 (10') is molded and grouted, the cross section of the formed first column 10 (10') is square as shown in FIG. 4C. In another embodiment of the instant disclosure, the cross section of the first column 10 (10') is not limited to square, but can be another shape, such as circular or oval, based on the design requirements.

In a specific embodiment of the instant disclosure, as shown in FIG. 4D, each stirrup of the first stirrup assembly 1001 (1001') is provided with a continuous strip-like reinforcing bar with a first end portion of the continuous strip-like reinforcing bar bent inwardly to form a first anchoring section 10013 (10013'), the middle portion of the continuous strip-like reinforcing bar is bent in a specific order (clockwise or counterclockwise) to generally form a square shape, and a second end portion of the continuous strip-like reinforcing bar is bent inwardly to form a second anchoring section 10014 (10014') such that each of the stirrups has a peripheral stirrup 10012 (10012'), a plurality of longitudinal tie bars 10013 (10013'), a plurality of latitudinal tie bars 10014 (10014') and two anchoring sections 10013 (10013'), 10014 (10014') wherein the first anchoring section 10013 (10013') is provided near the middle of a side of the square shape and the second anchoring section 10014 (10014') is provided near the middle of an adjacent side of the square shape. Such arrangement of the first stirrup assembly 1001 (1001') provides a good balance of tension. The arrangement of the stirrups and the tie bars as shown in FIG. 4D, which can be made in a factory beforehand by a machine, simplifies the processes of a conventional arrangement, in which the steel bars need to be cut, bent and tied by workers at the construction site.

Figure 5A:
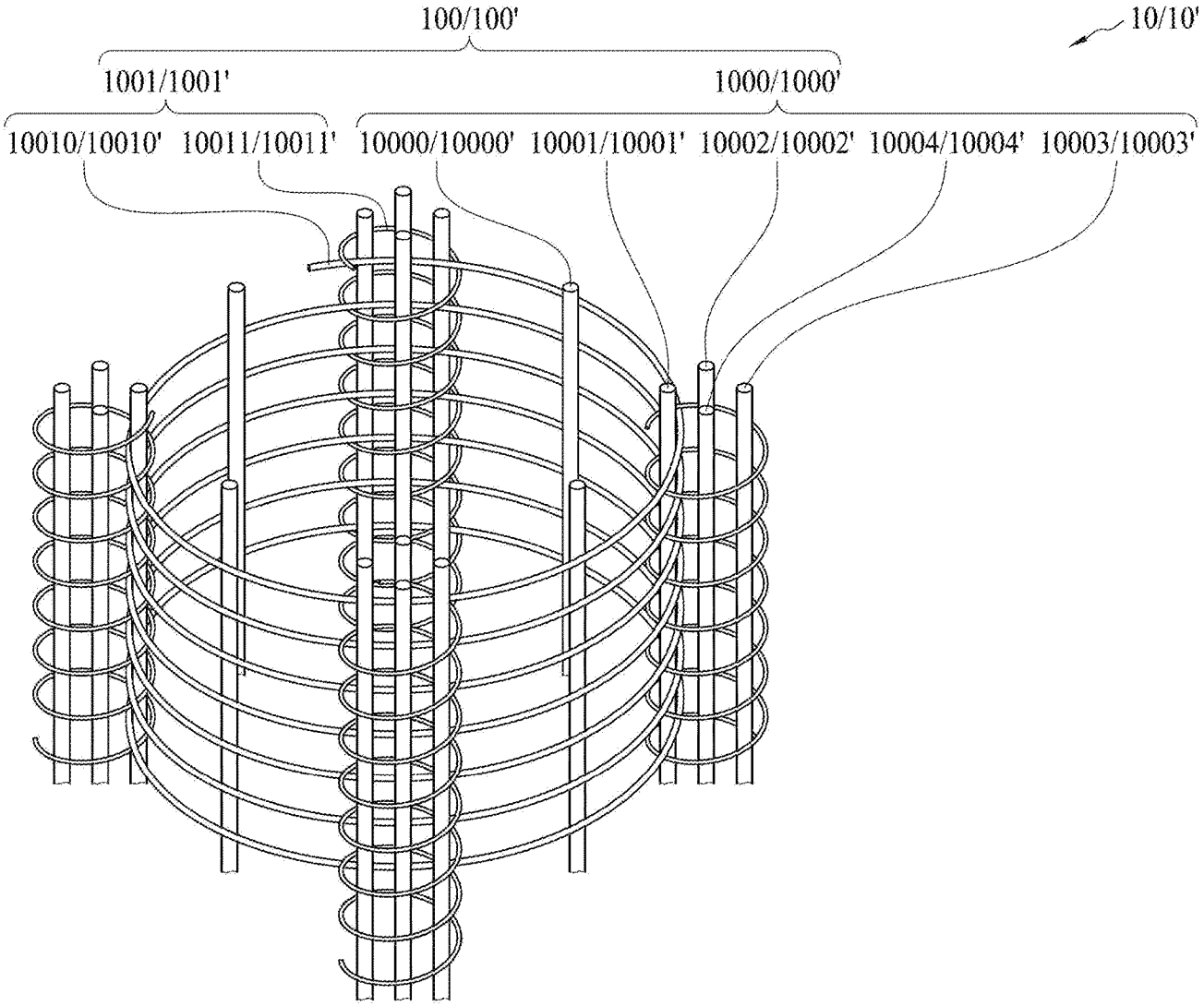
FIG. 5A is a perspective schematic view showing the structure of a steel cage used in a first column in accordance with one embodiment of the instant disclosure.
Figure 5B:
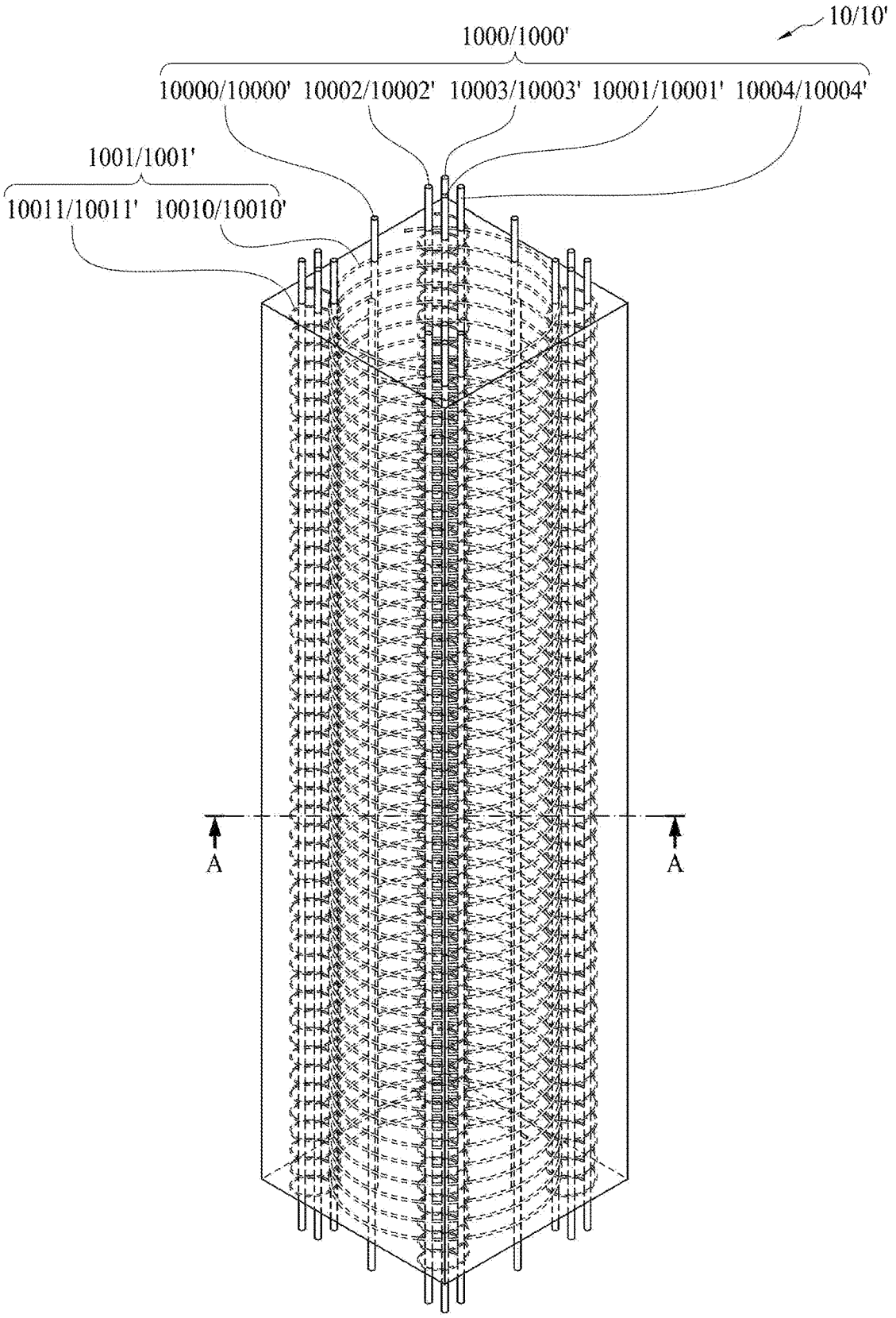
FIG. 5B is a perspective schematic view showing the structure of the first column with hardened reinforced concrete in accordance with one embodiment of the instant disclosure.
Figure 5C:
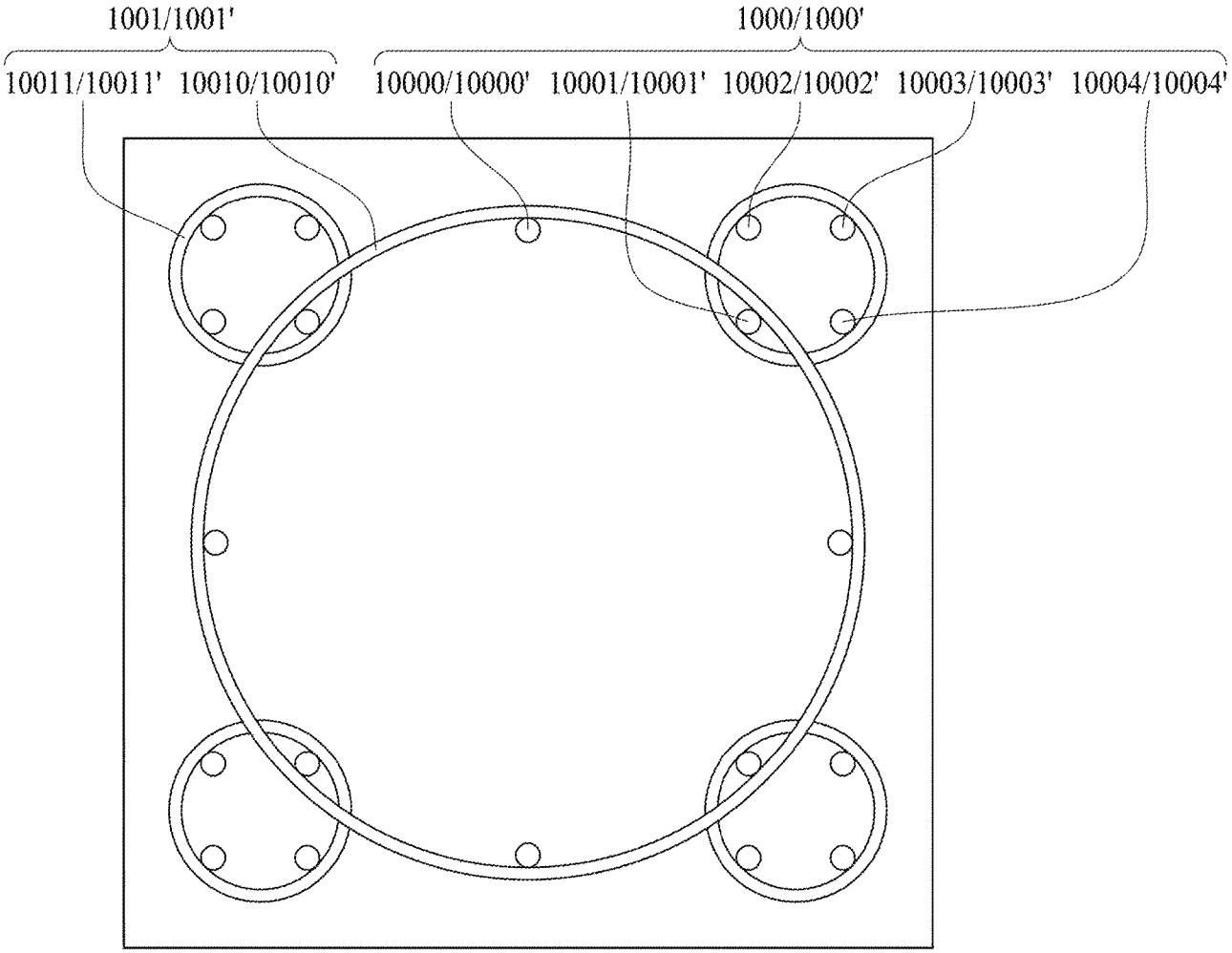
FIG. 5C is a cross sectional view of FIG. 5B.

Please refer to FIGS. 5A-5C. FIG. 5A is a perspective schematic view showing the structure of the steel cage used in the first column 10 (10') in accordance with one embodiment of the instant disclosure. FIG. 5B is a perspective schematic view showing the structure of the first column 10 (10') with hardened reinforced concrete in accordance with one embodiment of the instant disclosure. FIG. 5C is a cross sectional view of FIG. 5B. The structure of the first column 10 (10') of the first load-bearing column 1 or the second load-bearing column 1' is described below.

As shown in FIGS. 5A-5C, the first column 10 (10') of the first load-bearing column 1 or the second load-bearing column 1' comprises a first reinforcing bar assembly 100 (100') which is a steel cage. The first reinforcing bar assembly 100 (100') comprises a first main reinforcement assembly 1000 (1000') and a first stirrup assembly 1001 (1001). The first main reinforcement assembly 1000 (1000') comprises a plurality of main reinforcements arranged parallel to each other, which are respectively a first inner main reinforcement 10000 (10000'), a first middle main reinforcement 10001 (10001') and a plurality of first outer main reinforcements 10002 (10002'), 10003 (10003'), 10004 (10004'). The first stirrup assembly 1001 (1001') comprises a first main spiral stirrup 10010 (10010') and a plurality of first auxiliary spiral stirrups 10011 (10011').

The first main spiral stirrup 10010 (10010') surrounds the outer side of the first inner main reinforcement 10000 (10000'). In an embodiment of the instant disclosure, the first main spiral stirrup 10010 (10010') is circular as shown in FIGS. 5A-5C. In another embodiment of the instant disclosure, the first main spiral stirrup 10010 (10010') can be another shape, such as oval or square according to the design requirements.

The plurality of first auxiliary spiral stirrups 10011 (10011') are substantially arranged outside the first main spiral stirrup 10010 (10010'), and partially overlap the first main spiral stirrup 10010 (10010'). In an embodiment of the instant disclosure, the first auxiliary spiral stirrups 10011 (10011') have four auxiliary spiral stirrups and are symmetrically disposed as shown in FIGS. 5A-5C. In another embodiment of the instant disclosure, the number of first auxiliary spiral stirrups 10011 (10011') is not limited to four, but can be increased or decreased, such as two, three, five or six, according to the actual needs.

Each of the first middle main reinforcements 10001 (10001') is disposed between the first main spiral stirrup 10010 (10010') and the first auxiliary spiral stirrup 10011 (10011'). A plurality of first outer main reinforcements 10002 (10002'), 10003 (10003'), 10004 (10004") and the first middle are disposed outside the first main spiral stirrup 10011 (10011') and inside the first auxiliary spiral stirrup 10010 (10010'). The plurality of first outer main reinforcements 10002 (10002'), 10003 (10003'), 10004 (10004') and the first middle main reinforcement 10001 (10001') are disposed on the opposite side of the first main spiral stirrup 10010 (10010'). In an embodiment of the instant disclosure, the number of first outer main reinforcements is three as shown in FIGS. 5A-5C. In another embodiment of the instant disclosure, the number of first outer main reinforcements can be increased or decreased and the position thereof can also be adjusted based on actual needs. The main reinforcements and stirrups are fixed by wires, welding or both.

Figure 6A:
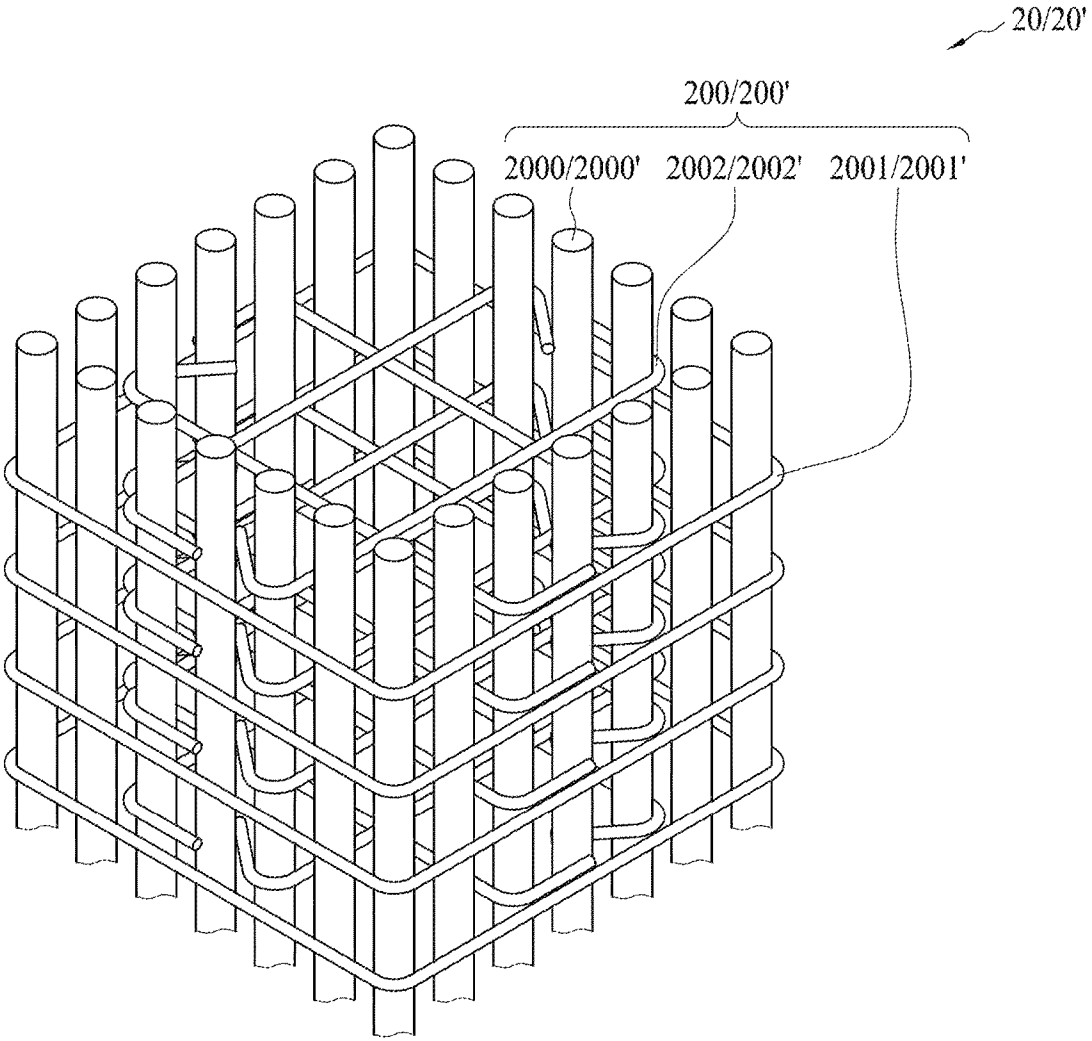
FIG. 6A is a perspective schematic view showing the structure of a steel cage used in a second column in accordance with one embodiment of the instant disclosure.
Figure 6B:
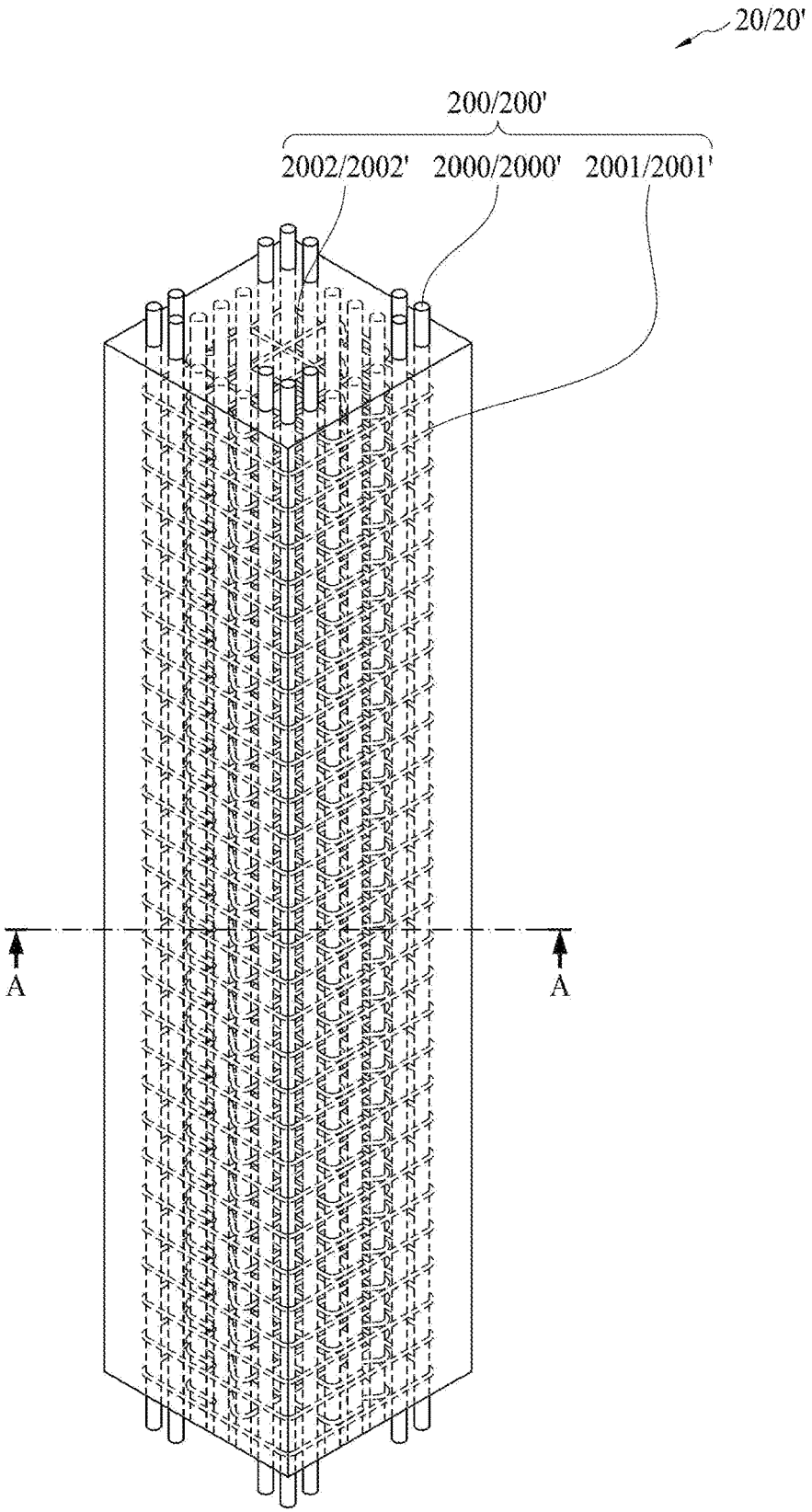
FIG. 6B is a perspective schematic view showing the structure of the second column with hardened reinforced concrete in accordance with one embodiment of the instant disclosure.
Figure 6C:
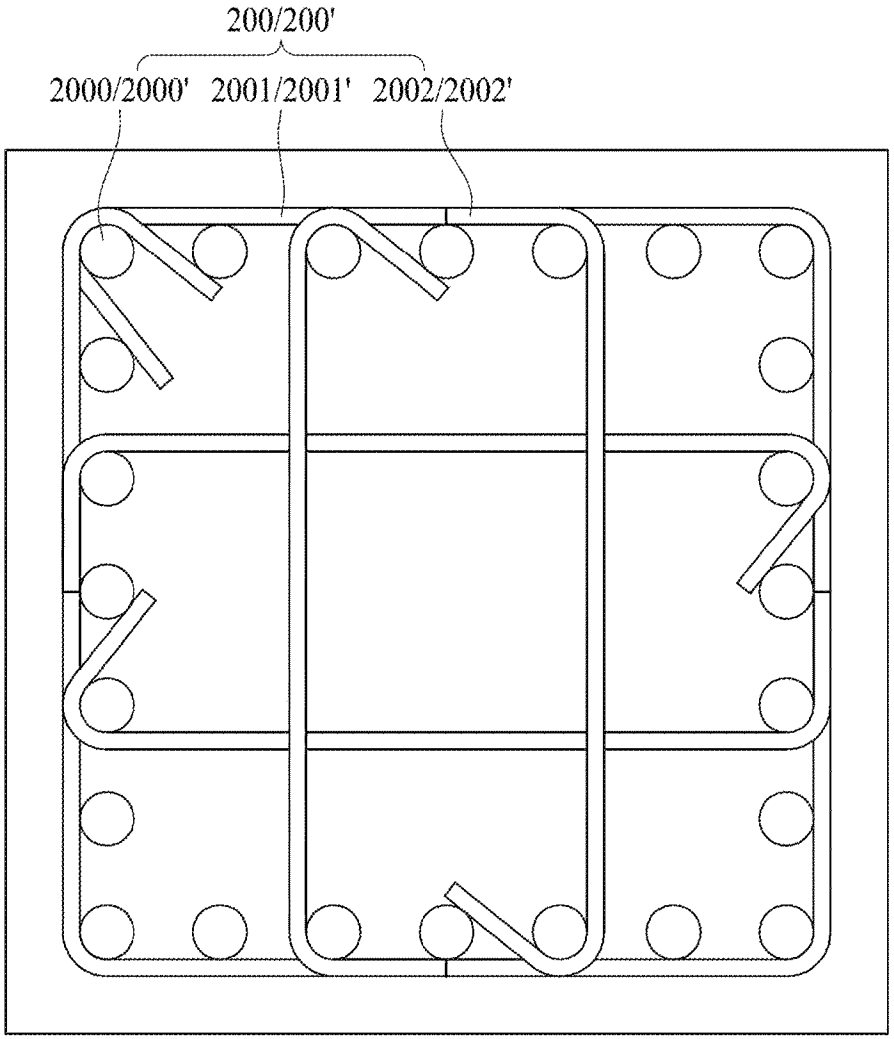
FIG. 6C is a cross sectional view of FIG. 6B.
Figure 6D:
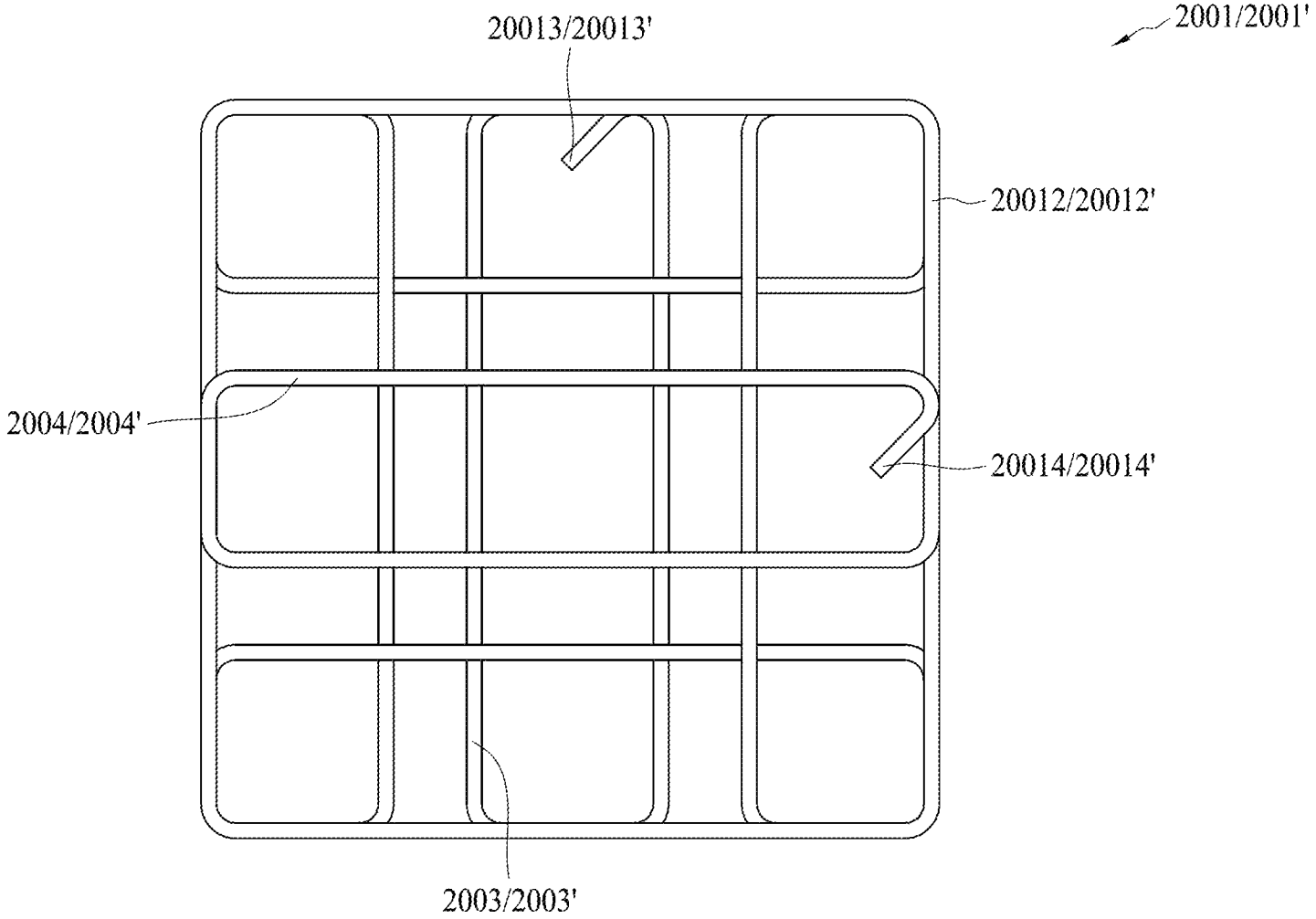
FIG. 6D is a schematic view of a stirrup of a second stirrup assembly that is bent to form a continuous strip-like reinforcing bar.

Please refer to FIGS. 6A-6D. FIG. 6A is a perspective schematic view showing the structure of the steel cage used in the second column 20 (20') in accordance with one embodiment of the instant disclosure. FIG. 6B is a perspective schematic view showing the structure of the second column 20 (203 with hardened reinforced concrete in accordance with one embodiment of the instant disclosure. FIG. 6C is a cross sectional view of FIG. 6B. FIG. 6D is a schematic view of a stirrup of a second stirrup assembly 2001 (2001') that is bent to form a continuous strip-like reinforcing bar. The structure of the second column 20 (20') of the first load-bearing column 1 or the second load-bearing column 1' is described below.

As shown in FIGS. 6A-6D, the second column 20 (20') of the first load-bearing column 1 or the second load-bearing column 1' before being formed with concrete comprises a second reinforcing bar assembly 200 (200') which is a steel cage as shown in FIG. 6A. The second reinforcing bar assembly 200 (200') comprises a second main reinforcement assembly 2000 (2000'), a second stirrup assembly 2001 (2001') and a second tie bar assembly 2002 (2002'). The second main reinforcement assembly 2000 (2000') comprises a plurality of main reinforcements arranged parallel to each other at a predetermined distance. The second stirrup assembly 2001 (2001') comprises a plurality of frame-shaped stirrups which enclose the second main reinforcement assembly 2000 (2000') at a predetermined axial distance to reinforce the shear resistance of the second column 20 (20'). The stirrups and main reinforcements are fixed to each other by wires, welding or both.

The second tie bar assembly 2002 (002') comprises a plurality of tie bars. Each tie bar comprises a first end and a second end, wherein the first end of the tie bar is hooked and secured to a third main reinforcement of the second main reinforcement assembly 2000 (2000'), and the second end of the tie bar is hooked and secured to a fourth main reinforcement of the second main reinforcement assembly 2000 (2000'), and the third main reinforcement corresponds to the fourth main reinforcement. The first end of the tie bar is bent at least an angle of 90° to 135° and the second end of the tie bar is bent at least an angle of 135° (as shown in FIG. 6C). The second column 20 (20') can be a reinforced concrete column made at a construction site or the prefabricated reinforced concrete column. In an embodiment of the instant disclosure, after the second column 20 (20') is molded and grouted, the cross section of formed the second column 20 (20') is square as shown in FIG. 6C. In another embodiment of the instant disclosure, the cross section of the second column 20 (20') is not limited to square, but can be another shape, such as circular or oval, based on the design requirements.

In a specific embodiment of the instant disclosure, as shown in FIG. 6D, each stirrup of the second stirrup assembly 2001 (2001') is provided with a continuous strip-like reinforcing bar with a first end portion of the continuous strip-like reinforcing bar bent inwardly to form a first anchoring section 20013 (20013'), the middle portion of the continuous strip-like reinforcing bar is bent in a specific order (clockwise or counterclockwise) to generally form a square shape, and a second end portion of the continuous strip-like reinforcing bar is bent inwardly to form a second anchoring section 20014 (20014') such that each of the stirrups has a peripheral stirrup 20012 (20012'), a plurality of longitudinal tie bars 20013 (20013'), a plurality of latitudinal tie bars 20014 (20014') and two anchoring sections 20013 (20013'), 20014 (20014') wherein the first anchoring section 20013 (10013') is provided near the middle of a side of the square shape and the second anchoring section 20014 (20014') is provided near the middle of an adjacent side of the square shape. Such arrangement of the second stirrup assembly 2001 (2001') provides a good balance of tension. The arrangement of the stirrups and the tie bars as shown in FIG. 6D, which can be made in a factory beforehand by a machine, simplifies the processes of a conventional arrangement, in which the steel bars need to be cut, bent and tied by workers at the construction site.

Figure 7A:
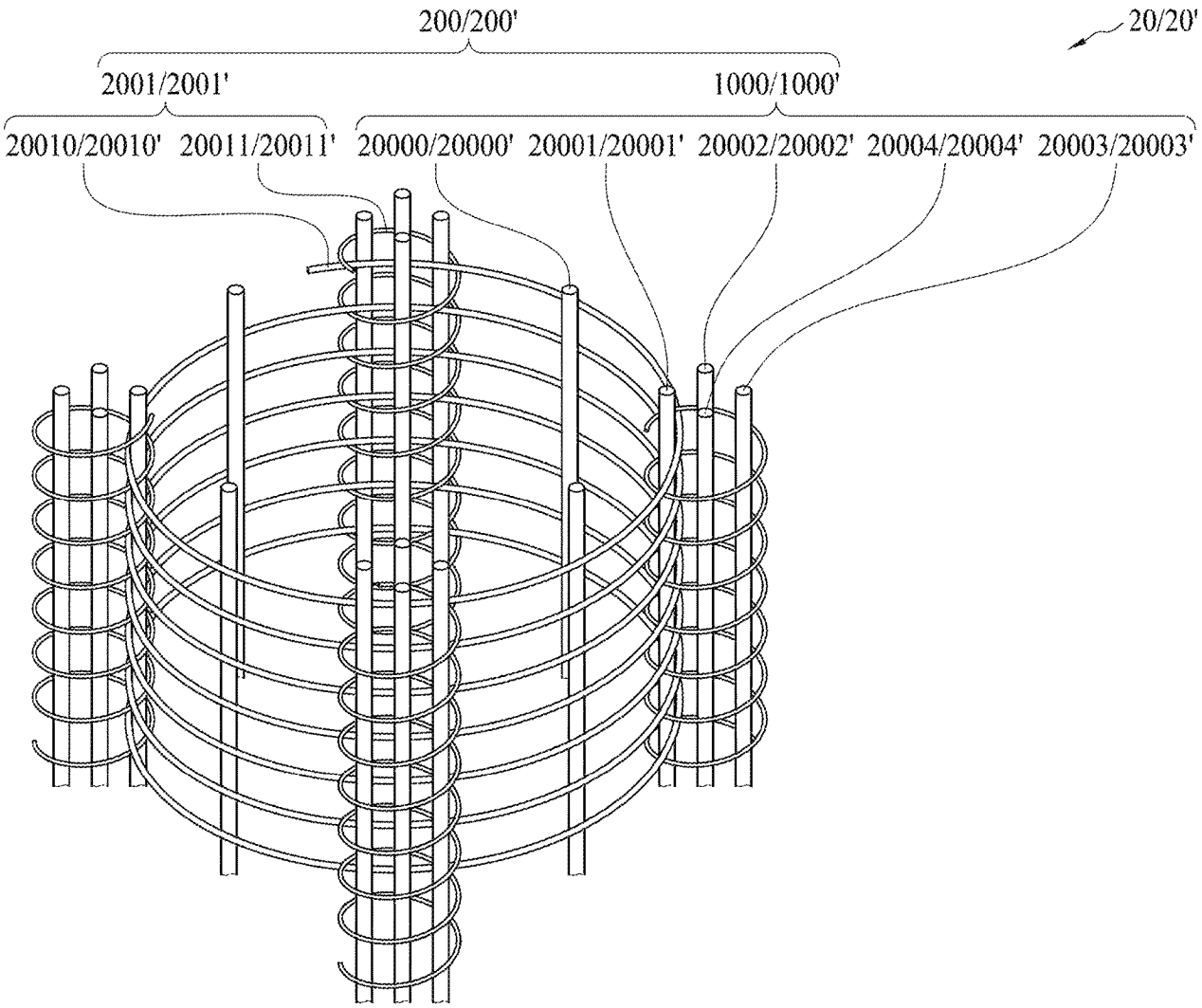
FIG. 7A is a perspective schematic view showing the structure of a steel cage used in the second column in accordance with one embodiment of the instant disclosure.
Figure 7B:
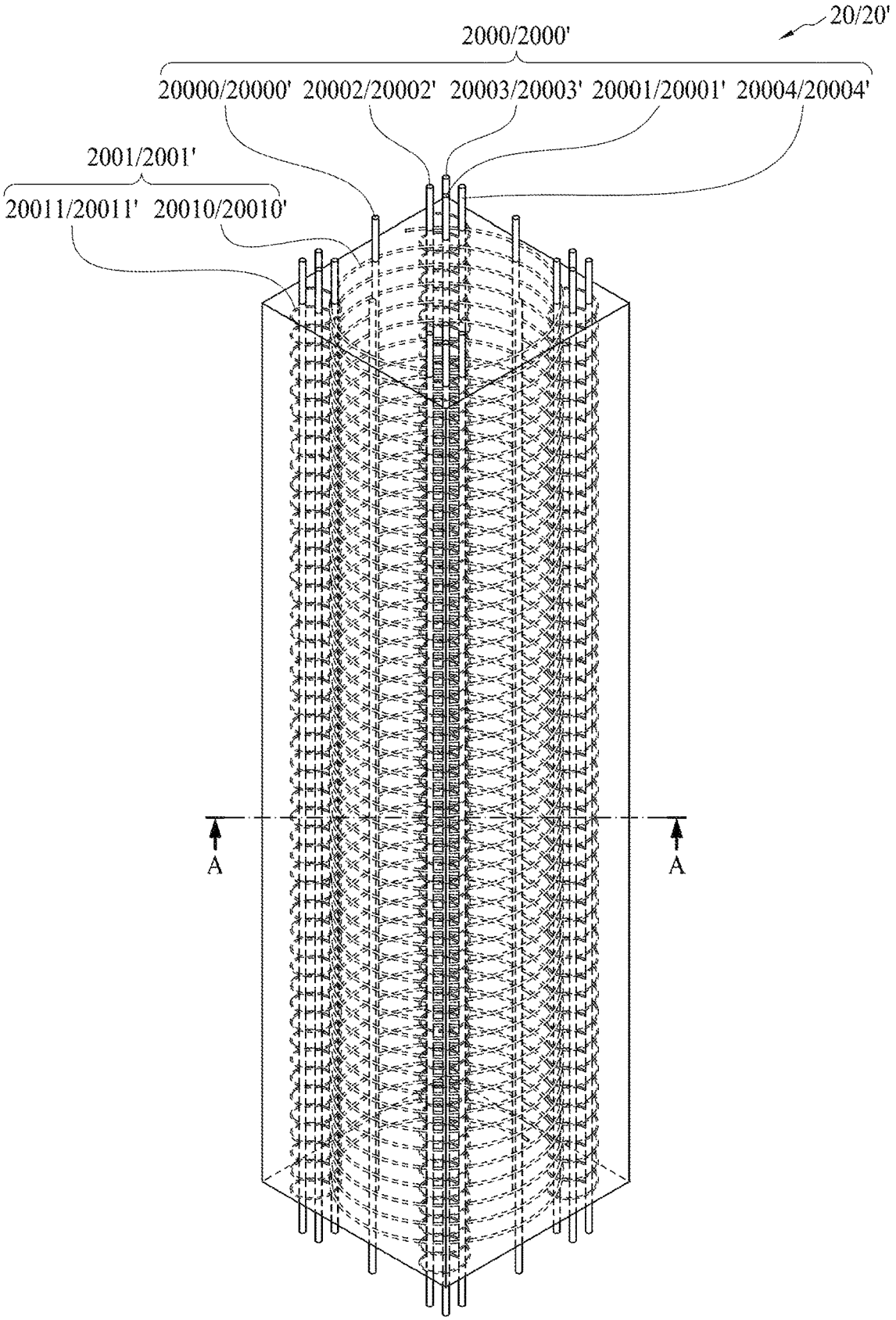
FIG. 7B is a perspective schematic view showing the structure of the second column with hardened reinforced concrete in accordance with one embodiment of the instant disclosure.
Figure 7C:
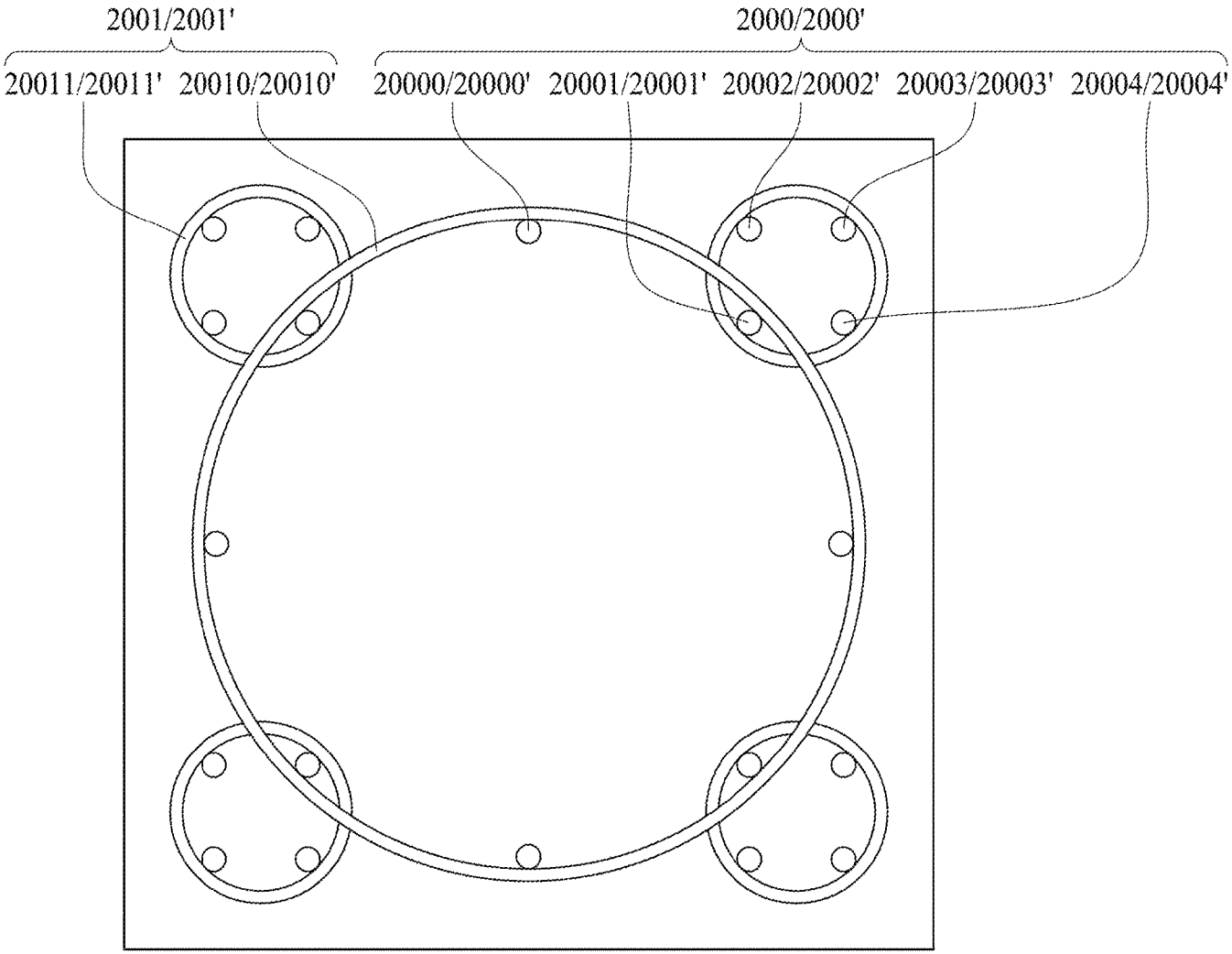
FIG. 7C is a cross sectional view of FIG. 7B.

Please refer to FIGS. 7A-7C. FIG. 7A is a perspective schematic view showing the structure of the steel cage used in the second column 20 (20') in accordance with the one embodiment of the instant disclosure. FIG. 7B is a perspective schematic view of showing the structure of the second column 20 (20') with hardened reinforced concrete in accordance with the one embodiment of the instant disclosure. FIG. 7C is a cross sectional view of FIG. 7B. The structure of the second column 20 (20') of the first load-bearing column 1 or the second load-bearing column 1' is described below.

As shown in FIGS. 7A-7C, the second column 20 (20') of the first load-bearing column 1 or the second load-bearing column 1' comprises a second reinforcing bar assembly 200 (200') which is a steel cage. The second reinforcing bar assembly 200 (200') comprises a second main reinforcement assembly 2000 (2000') and a second stirrup assembly 2001 (2001'). The second main reinforcement assembly 2000 (2000') comprises a plurality of main reinforcements arranged parallel to each other, which are respectively a second inner main reinforcement 20000 (20000'), a second middle main reinforcement 20001 (20001') and a plurality of second outer main reinforcements 20002 (20002'), 20003 (20003'), 20004 (20004'). The second stirrup assembly 2001 (2001') comprises a second main spiral stirrup 20010 (20010') and a plurality of second auxiliary spiral stirrups 20011 (20011').

The second main spiral stirrup 20010 (20010') surrounds the outside of the second inner main reinforcement 20000 (20000'). In an embodiment of the instant disclosure, the second main spiral stirrup 20010 (20010') is circular (as shown in FIGS. 7A-7C). In another embodiment of the instant disclosure, the second main spiral stirrup 20010 (20010') can be another shape, such as oval or square based the design requirements.

The plurality of second auxiliary spiral stirrups 20011 (20011') are substantially arranged outside the second main spiral stirrup 20010 (20010'), and partially overlap the second main spiral stirrup 20010 (20010'). In an embodiment of the instant disclosure, the second auxiliary spiral stirrups 20011 (20011') have four auxiliary spiral stirrups and are symmetrically disposed as shown in FIGS. 7A-7C. In another embodiment of the instant disclosure, the number of second auxiliary spiral stirrups 20011 (20011') is not limited to four, but can be increased or decreased, such as two, three, five or six, according to the actual needs.

Each of the second middle main reinforcements 20001 (20001') is disposed between the second main spiral stirrup 20010 (20010') and the second auxiliary spiral stirrup 20011 (20011'). A plurality of second outer main reinforcements 20002 (20002'), 20003 (20003'), 20004 (20004") are disposed outside the second main spiral stirrup 20011 (20011') and inside the second auxiliary spiral stirrup 20010 (20010'). The plurality of second outer main reinforcements 20002 (20002'), 20003 (20003'), 20004 (20004') and the second middle main reinforcement 20001 (20001') are disposed on the opposite side of the second main spiral stirrup 20010 (20010'). In an embodiment of the instant disclosure, the number of second outer main reinforcements is three as shown in FIGS. 7A-7C. In another embodiment of the instant disclosure, the number of second outer main reinforcements can be increased or decreased and the position thereof can also be adjusted based on actual needs. The main reinforcements and the stirrups are fixed by wire, welding or both.

Figure 8A:
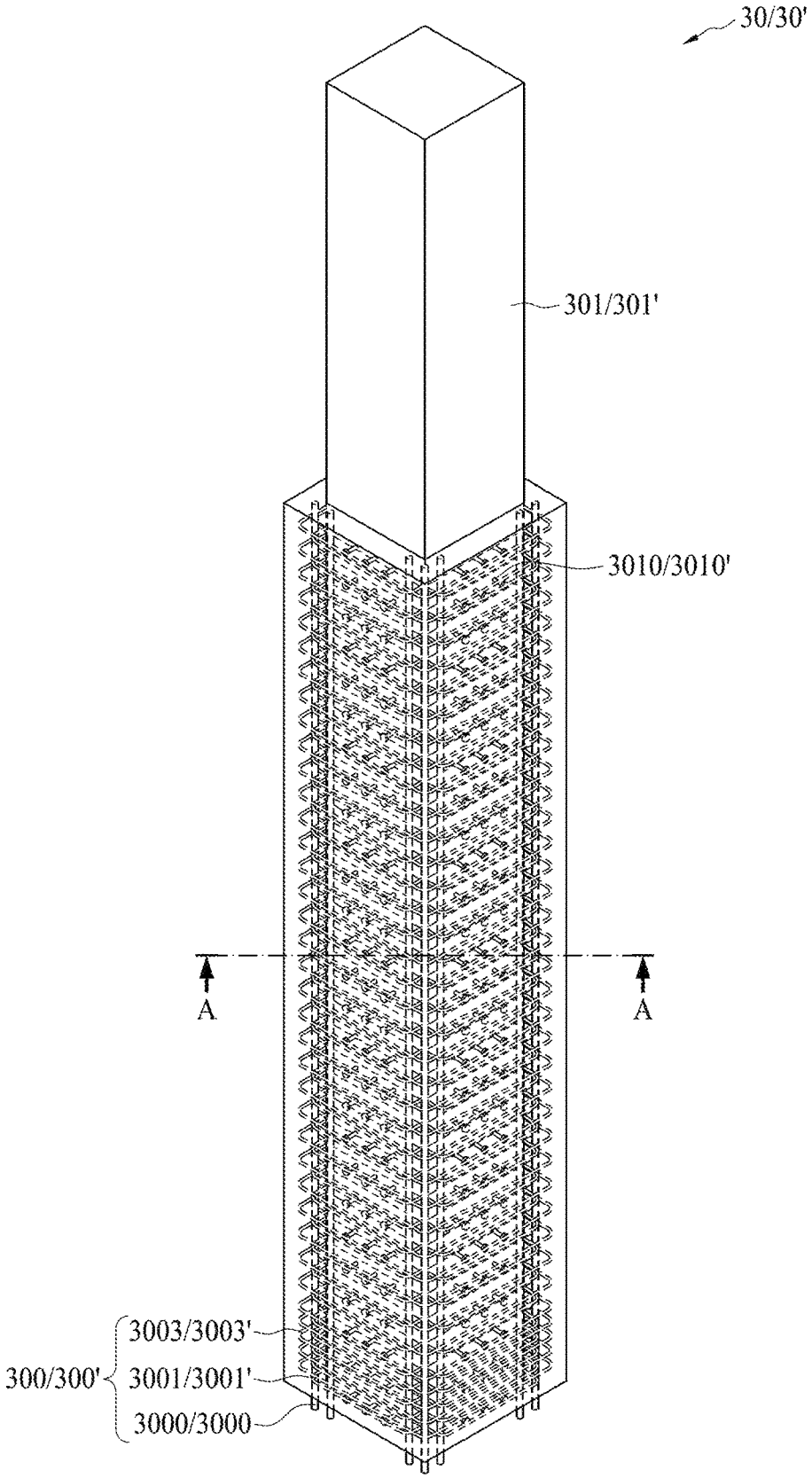
FIG. 8A is a perspective schematic view showing the structure of a third column in accordance with one embodiment of the instant disclosure.
Figure 8B:
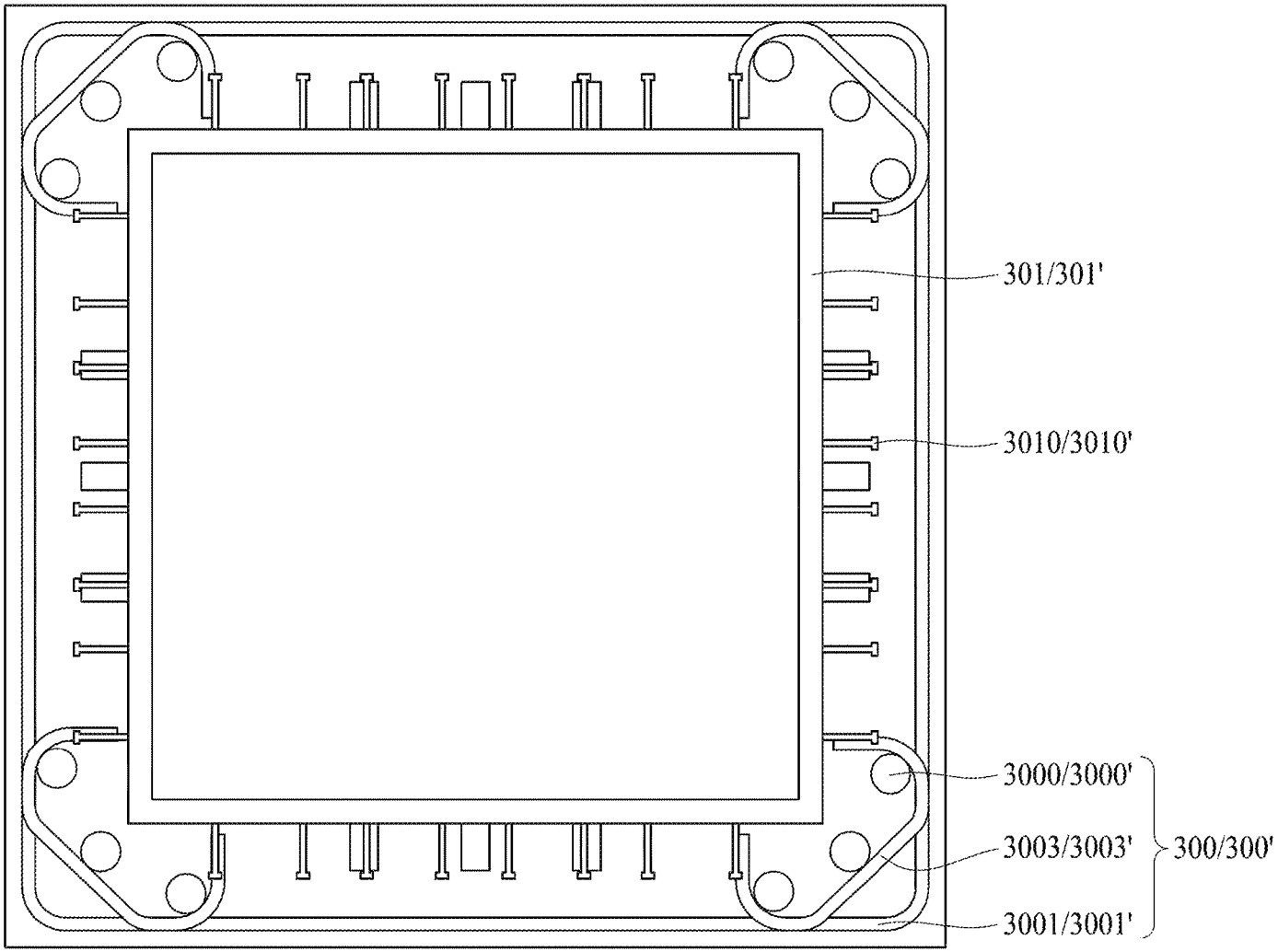
FIG. 8B is a cross sectional view of FIG. 8A.

Please refer to FIGS. 8A and 8B. FIG. 8A is a perspective schematic view showing the structure of the third column 30 (30') in accordance with one embodiment of the instant disclosure. FIG. 8B is a cross sectional view of FIG. 8A. The structure of the third column 30 (30') of the first load-bearing column 1 or the second load-bearing column 1' is described below.

As shown in FIGS. 8A and 8B, the third column 30 (30') comprises a steel column 301 (301') and a third reinforcing bar assembly 300 (300') which surrounds a partial outer portion of the steel column 301 (301'). The third reinforcing bar assembly 300 (300') not only enhance the strength of the steel column 301 (301'), but also mitigate the resonance effect while the steel column 301 (301') is subject to lateral force. The third reinforcing bar assembly 300 (300') comprises a third main reinforcements assembly 3000 (3000'), a third stirrup assembly 3001 (3001'), and a plurality of third auxiliary reinforcements 3003 (3003'). The third main reinforcement assembly 3000 (3000') comprises a plurality of main reinforcements arranged parallel to each other outside the steel column 300 (300'). The third stirrup assembly 3001 (3001') comprises a plurality of frame-shaped stirrups enclosed the third main reinforcement assembly 3000 (3000') at a predetermined axial distance. The main reinforcements, stirrups and auxiliary reinforcements are fixed by wires, welding or both.

The plurality of third auxiliary reinforcements 3003 (3003') are each substantially located at a corner of the steel column 301 (301') and substantially C-shaped with an opening toward the steel column 301 (301'), which can prevent the main reinforcements from moving laterally outward (as shown in FIG. 8B). In an embodiment of the instant disclosure, the third auxiliary reinforcement 3003 (3003') has a first end and a second end, wherein the first end is hooked and secured to a fifth main reinforcement(s) of the third main reinforcement assembly 3000 (3000') and the second end is hooked and secured to a sixth main reinforcement(s) of the third main reinforcement assembly 3000 (3000'). In another embodiment of the instant disclosure, the third auxiliary reinforcements 3003 (3003') are not limited to being C-shaped but can be another shape with an equivalent function.

The steel column 301 (301') is provided with a plurality of shear studs 3010 (3010') thereon for enhancing the connection between the steel column 301 (301') and the concrete to be applied thereto. In an embodiment of the instant disclosure, the cross section of the steel column 301 (301') is square (as shown in FIG. 8B). In another embodiment of the instant disclosure, the cross section of the steel column 301 (301') is not limited to being square, but can be another shape, such as I-shaped or circular. After the third column 30 (30') is molded and grouted, the cross section of the third column 30 (30') is square as shown in FIG. 8B, but it can be another shape, such as circular or oval, based on design requirements.

Figure 9A:
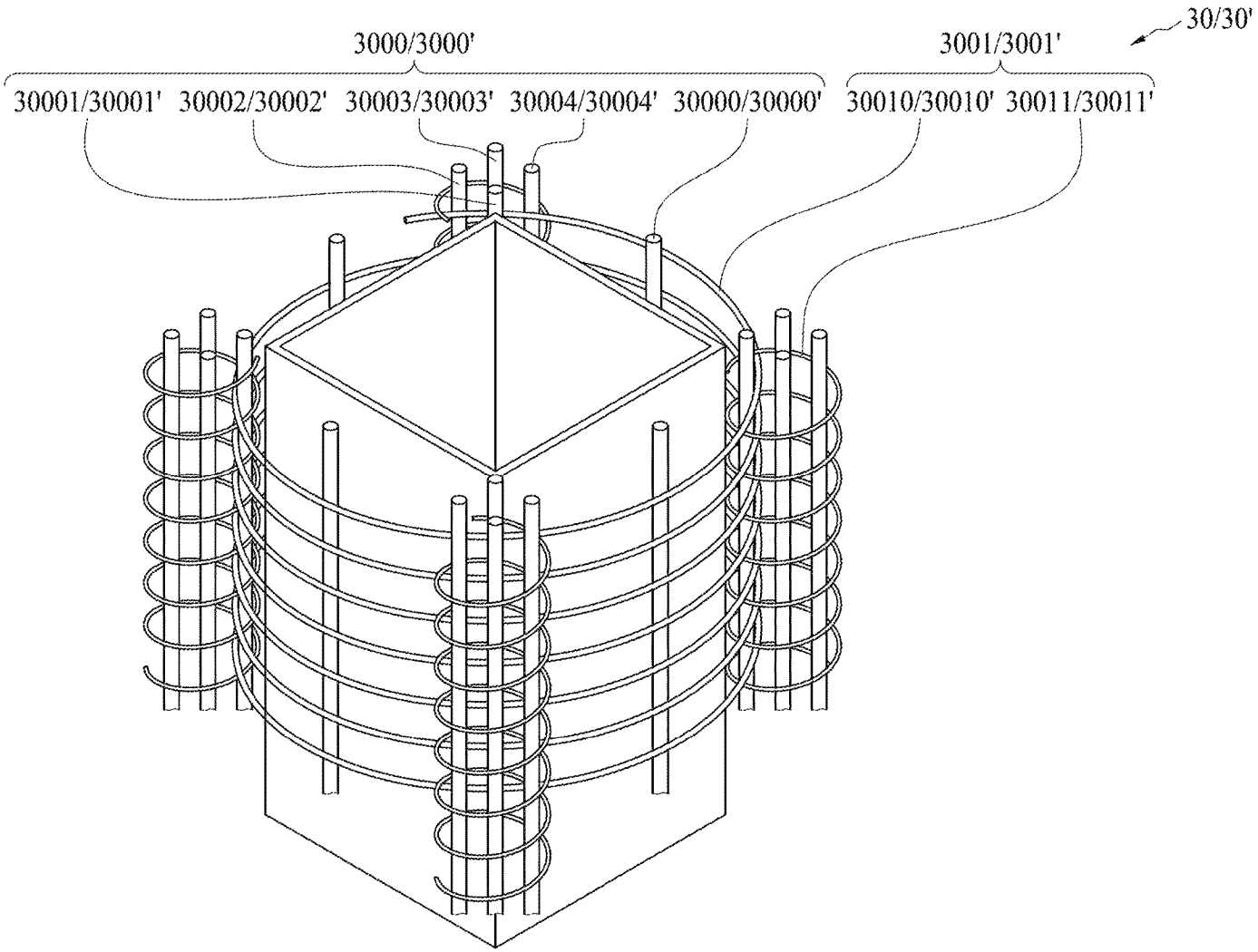
FIG. 9A is a perspective schematic view showing the structure of a steel cage used in the third column in accordance with one embodiment of the instant disclosure.
Figure 9B:
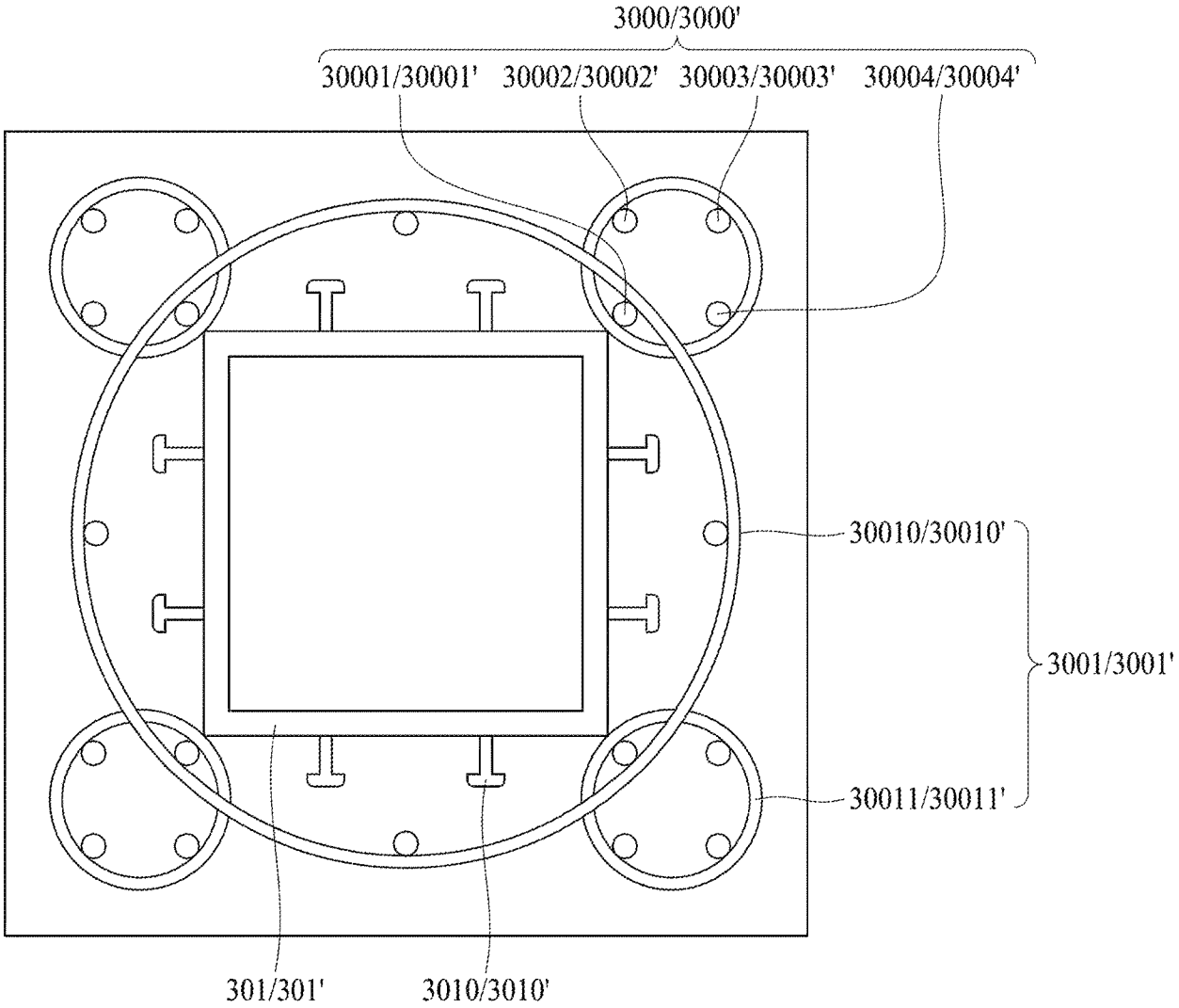
FIG. 9B is a perspective schematic view showing the structure of a steel reinforced concrete column used in the third column in accordance with one embodiment of the instant disclosure.

Please refer to FIGS. 9A and 9B. FIG. 9A is a perspective schematic view showing the structure of a steel cage used in the third column 30 (30') in accordance with one embodiment of the instant disclosure. FIG. 9B is a perspective schematic view showing the structure of the third column 30 (30') with hardened reinforced concrete in accordance with one embodiment of the instant disclosure. The third column 30 (30') of the first load-bearing column 1 or the second load-bearing column 1' is described below.

As shown in FIGS. 9A and 9B, the third reinforcing bar assembly 300 (300') of the third column 30 (30') comprises a third main reinforcement assembly 3000 (3000') and a third stirrup assembly 3001 (3001'). The third main reinforcement 3000 (3000') comprises a plurality of main reinforcements arranged parallel to each other outside the steel column 300 (300'), including respectively a third inner main reinforcement 30000 (30000'), a third middle main reinforcement 30001 (30001') and a plurality of third outer main reinforcements 30002 (30002'), 30003 (30003'), 30004 (30004'). The third stirrup assembly 3001 (3001') comprises a third main spiral stirrup 30010 (30010') and a plurality of third auxiliary spiral stirrups 30011 (30011').

The third main spiral stirrup 30010 (30010') surrounds and connects to the outside of the third inner main reinforcement 30000 (30000'). In an embodiment of the instant disclosure, the third main spiral stirrup 30010 (30010') is circular as shown in FIGS. 9A and 9B. In another embodiment of the instant disclosure, the third main spiral stirrup 30010 (30010') is not limited to circular but can be another shape, such as oval or polygon.

The plurality of third auxiliary spiral stirrups 30011 (30011') are substantially arranged outside the third main spiral stirrup 30010 (30010'), and partially overlap the third main spiral stirrup 30010 (30010'). In an embodiment of the instant disclosure, the number of third auxiliary spiral stirrups 30011 (30011') is four, and the third auxiliary spiral stirrups 30011 (30011') are symmetrically as shown in FIGS. 9A and 9B. In another embodiment of the instant disclosure, the number of third auxiliary spiral stirrups 30011 (30011') is not limited to four, but can be another appropriate number, such as two, three, five or six. The third middle main reinforcement 30001 (30001') is disposed between the third main spiral stirrup 30010 (30010') and the third auxiliary spiral stirrup 30011 (30011'). The third outer main reinforcements 30002 (30002'), 30003 (30003'), 30004 (30004') are disposed inside the third auxiliary spiral stirrup 30010 (30010') and outside the third main spiral stirrup 30011 (30011'). The third outer main reinforcements 30002 (30002'), 30003 (30003'), 30004 (30004') and the third middle main reinforcement 30001 (30001') are disposed on the opposite side of the outer main reinforcements 30002 (30002'). In an embodiment of the instant disclosure, the number of third outer main reinforcements is three (as shown in FIGS. 9A and 9B). In another embodiment of the instant disclosure, the number of third outer main reinforcements can be increased or decreased and the position thereof can also be adjusted based on the actual needs. The main reinforcements and the stirrups are fixed by wires, welding or both.

The steel column 301 (301') is provided with a plurality of shear studs 3010 (3010') thereon for enhancing the connection between the steel column 301 (301' and the concrete to be applied thereto. In an embodiment of the instant disclosure, the cross section of the steel column 301 (301') is square as shown in FIGS. 9A and 9B. In another embodiment of the instant disclosure, the cross section of the steel column 301 (301') is not limited to being square, but can be another shape, such as I-shaped or circular. After the third column 30 (30') is molded and grouted, the cross section of the third column 30 (30') is square as shown in FIGS. 9A and 9B, but in other embodiments, it can be another shape, such as circular or oval, based on actual needs.

Figure 10:
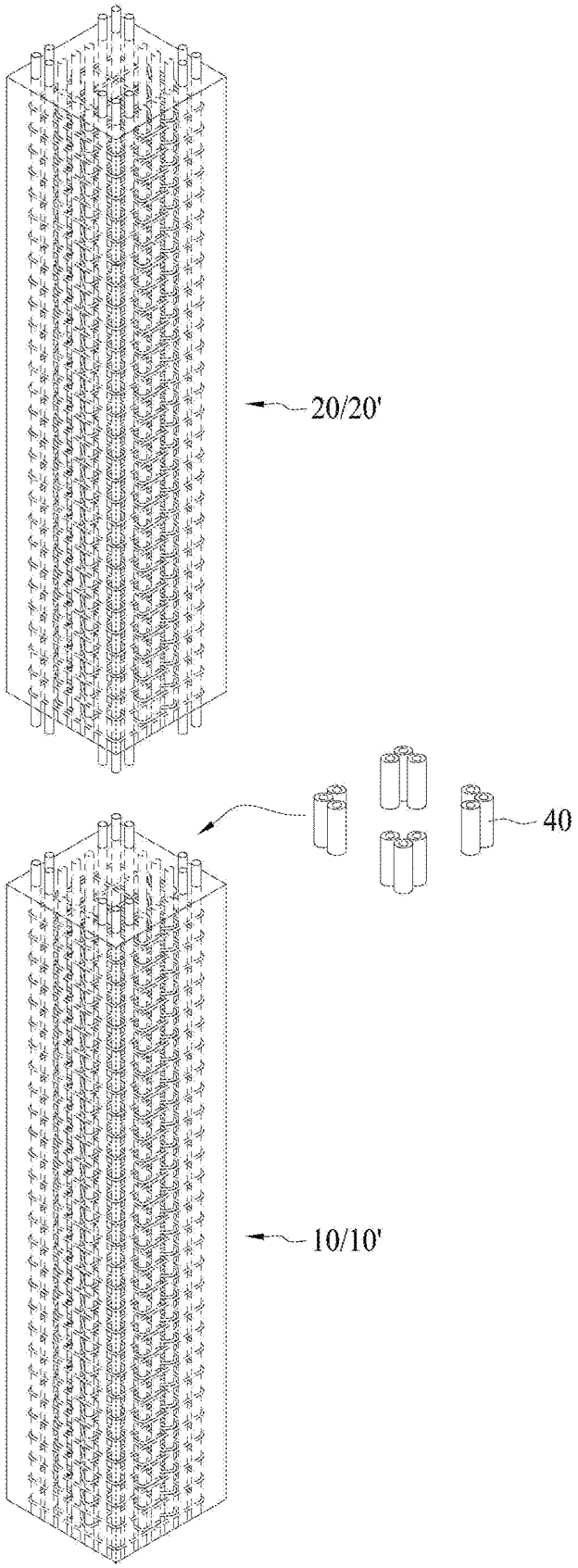
FIG. 10 is a perspective schematic view showing the connection of the first column with the second column by pipe-type couplers in one embodiment of the instant disclosure.

Please refer to FIG. 10. FIG. 10 is a perspective schematic view showing the connection of the first column 10 (10') with the second column 20 (20') by pipe-type couplers 40 in one embodiment of the instant disclosure. The connection of the first column 10 (10') to the second column 20 (20') of the first load-bearing column 1 or the second load-bearing column 1' is described below.

In an exemplary embodiment of the instant disclosure as shown in FIG. 10, the first column 10 (10') is fixed to the top of the second column 20 (20'). A portion of main reinforcements of the first column 10 (10') protrude from the top of the first column 10 (10'), wherein the protruding portions of the main reinforcements have external threads (not shown). The second column 20 (20') is a pre-fabricated reinforced concrete column. A portion of main reinforcements of the second column 20 (20') protrude from the bottom of the second column 20 (20') wherein the protruding portions of the main reinforcements have external threads (not shown). Further, the protruding portions of the second column 20 (20') corresponds to the protruding portions of the first column 10 (10') in locations.

The pipe-type couplers 40 have internal threads in the upper end and the lower end thereof, and they respectively correspond to the external threads of the first column 10 (10') and those of the second column 20 (20'). One end of each pipe-type coupler 40 is rotatably fitted to the protruding portion of the main reinforcements of the first column 10 (10') to a predetermined first distance, and then rotate in the opposite direction such that the other ends of the pipe-type couplers 40 are rotatably fitted to the protruding portion of the main reinforcements of the second column 20 (20') and further move to a predetermined second distance, and thus the second column 20 (20') is fixed to the top of the first column 10 (10'). The predetermined first distance is greater than the predetermined second distance. Finally, the connection portion of the first column 10 (10') and the second column 20 (20') is further molded and grouted with cement mortar.

In another embodiment of the instant disclosure, the protruding portions of the main reinforcements of the first column 10 (10') are basically the same in length, and so are the protruding portions of the main reinforcements of the second column 20 (20'). Thus, all the pipe-type couplers 40 after being rotatably fitted to the protruding portion of the main reinforcements of the first column 10 (10') and those of the second column 20 (20') are substantially at the same height from the ground.

In another embodiment of the instant disclosure, the protruding portions of the reinforcements of the first column 10 (10') can be different in length, and so can the protruding portions of the reinforcements of the second column 20 (20'), though they need to correspond to each other. Thus, the pipe-type couplers 40 are not all at the same height after being rotatably fitted to the protruding portion of the reinforcements of the first column 10 (10') and those of the second column 20 (20'). Since the couplers 40 typically will be structurally weak in the connection between first column 10 (10') or the second column 20 (20'), such arrangement can avoid concentration of structural weak points.

Figure 11:
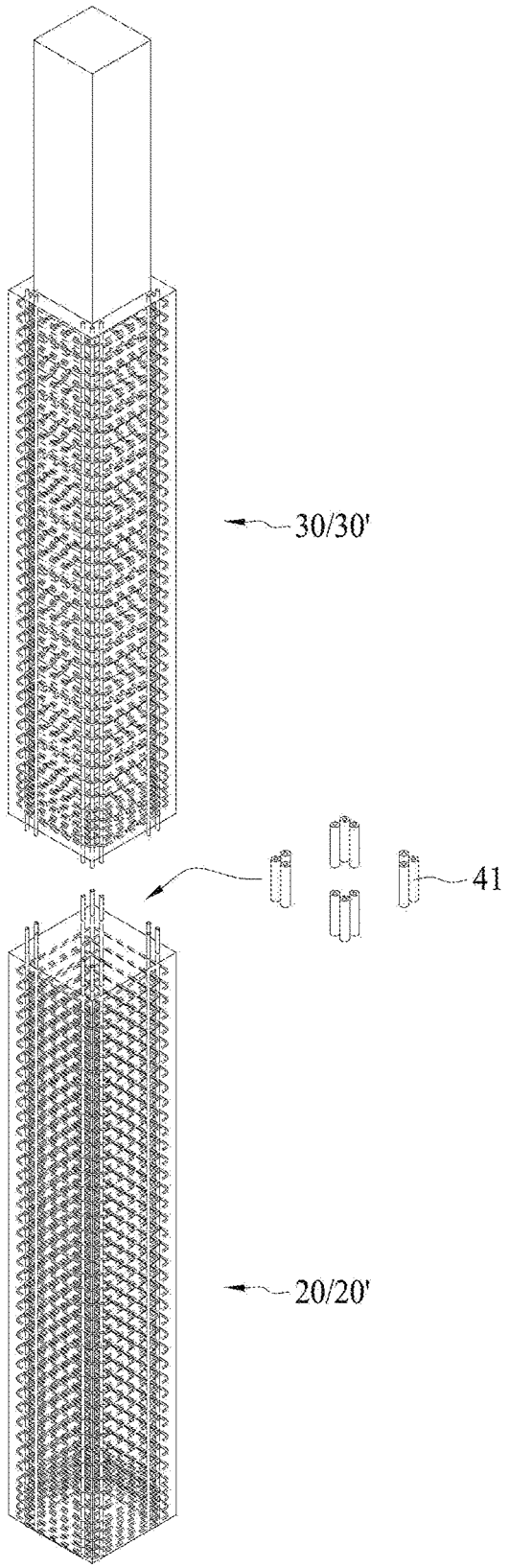
FIG. 11 is a perspective schematic view showing the connection of the second column with the third column by pipe-type couplers in one embodiment of the instant disclosure.

Please refer to FIG. 11. FIG. 11 is a perspective schematic view showing connection the second column 20 (20') with the third column 30 (30') by pipe-type couplers 41 in one embodiment of the instant disclosure. In an exemplary embodiment of the instant disclosure as shown in FIG. 11, the second column 20 (20') is fixed to the top of the third column 30 (30'). A portion of main reinforcements of the second column 20 (20') protrude from the top of the second column 20 (20'), wherein the protruding portions of the main reinforcements has external threads (not shown). The third column 30 (30') is a pre-fabricated steel reinforced concrete column. A portion of main reinforcements of the third column 30 (30') protrude from the bottom of the third column 30 (30'), wherein the protruding portions of the main reinforcements have external threads (not shown). Further, the protruding portions of the third column 30 (30') corresponds to the protruding portions of the second column 20 (20') in locations.

The structure of pipe-type couplers 41 shown in FIG. 10 is identical to that of the pipe-type couplers 40 shown in FIG. 11, so the way of fitting the pipe-type couplers 41 to the protruding portion of the main reinforcements of the second column 20 (20') and those of the third column 30 (30') is the same as described above for connecting the first column 10 (10') and the second column 20 (20').

In another embodiment of the instant disclosure, the protruding portions of the main reinforcements of the second column 20 (20') are basically the same, and so are the protruding portion of the main reinforcements of the third column 30 (30'). Thus, all pipe-type couplers 41 after being rotatably fitted to the protruding portion of the main reinforcements of the second column 20 (20') and the third column 30 (30') are substantially at the same height from the ground.

In another embodiment of the instant disclosure, the protruding portions of the reinforcements of the second column 20 (20') can be different in length, and so are protruding portions of the reinforcements of the third column 30 (30'), though they need to correspond to each other. Thus, the pipe-type couplers 41 are not all at the same height after being rotatably fitted to the protruding portion of the reinforcements of the second column 20 (20') and those of the third column 30 (30'). Since the couplers 41 typically will be structurally weak in the connection between the second column 20 (20') or the third column 30 (30'), such arrangement can avoid concentration of structural weak points.

Figure 12:
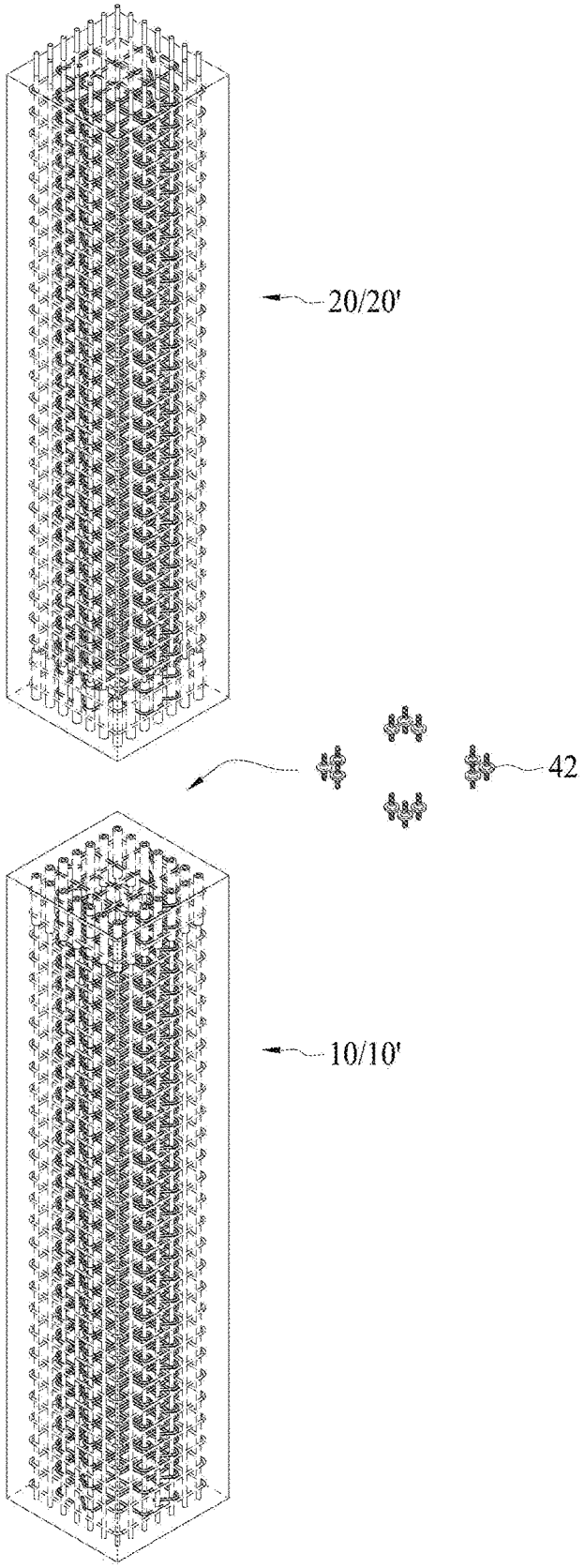
FIG. 12 is a perspective schematic view showing the connection of the first column with the second column by screw-type couplers in one embodiment of the instant disclosure.

Please refer to FIG. 12. FIG. 12 is a perspective schematic view showing the connection of the first column 10 (10') with the second column 20 (20') in the first load-bearing column 1 or the second load-bearing column 1' by screw-type couplers 42 in one embodiment of the instant disclosure.

The screw-type couplers 42 have external threads at the upper end and the lower end thereof. The upper ends of the main reinforcements of the first column 10 (10') have sleeves embedded therein, wherein the sleeves have internal threads corresponding to the lower external threads of the screw-type couplers 42. The lower ends of the main reinforcements of the second column 20 (20') have sleeves embedded therein, wherein the sleeves have internal threads corresponding to the upper external threads of the screw-type couplers 42. The second column 20 (20') is fixed to the top of the first column 10 (10') when the screw-type couplers 42 are fitted to the sleeves embedded in main reinforcements of the first column 10 (10') and those of the second column 20 (20'). Thereafter, the connection portion of the first column 10 (10') and the second column 20 (20') is molded and grouted with cement mortar.

Figure 13:
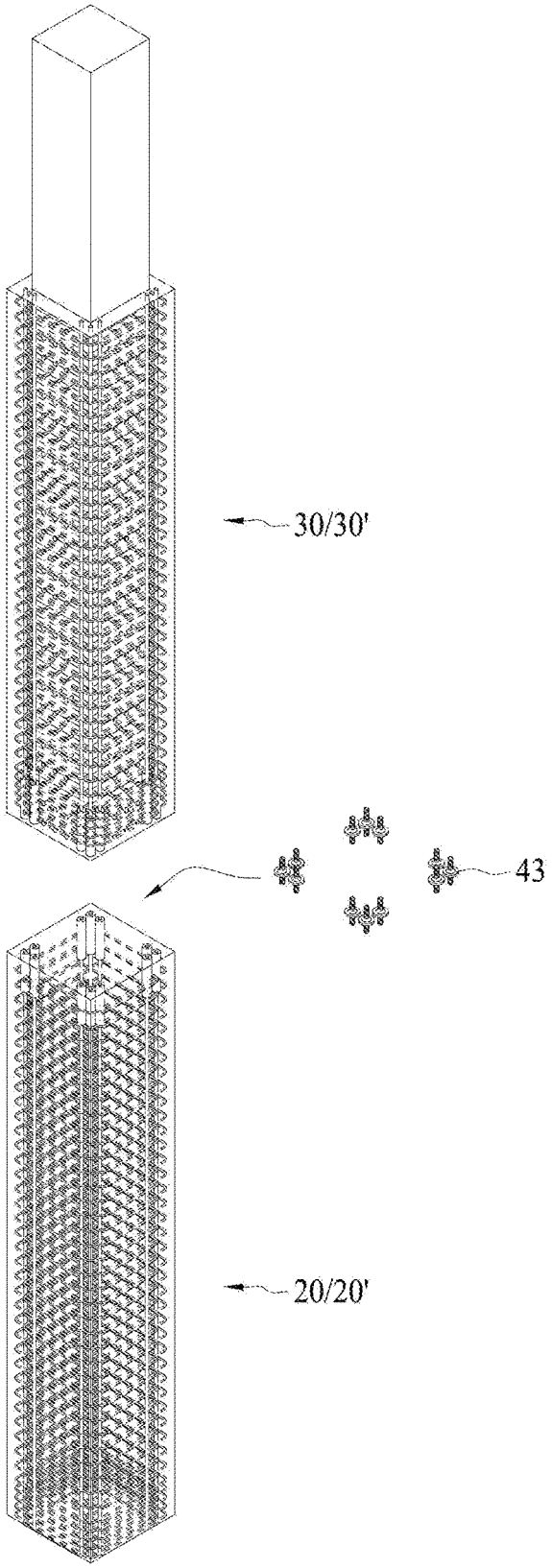
FIG. 13 is a perspective schematic view showing the connection of the second column with the third column by screw-type couplers in one embodiment of the instant disclosure.

Please refer to FIG. 13. FIG. 13 is a perspective schematic view showing connection of the second column 20 (20') with the third column 30 (30') by screw-type couplers 43 in one embodiment of the instant disclosure.

The screw-type couplers 43 have external threads at the upper end and the lower end thereof. The upper ends of the main reinforcements of the second column 20 (20') have sleeves embedded therein, wherein the sleeves have internal threads corresponding to the lower external threads of the screw-type couplers 43. The lower ends of the main reinforcements of the third column 30 (30') have sleeves embedded therein, wherein the sleeves have internal threads corresponding to the upper external threads of the screw-type couplers 43. The third column 30 (30') is fixed to the top of the second column 20 (20') when the screw-type couplers 43 are fitted to the sleeves embedded in the main reinforcements of the second column 20 (20') and those of the third column 30 (30'). Thereafter, the connection portion of the second column 20 (20') and the third column 30 (30') is molded and grouted with cement mortar.

Figure 14:
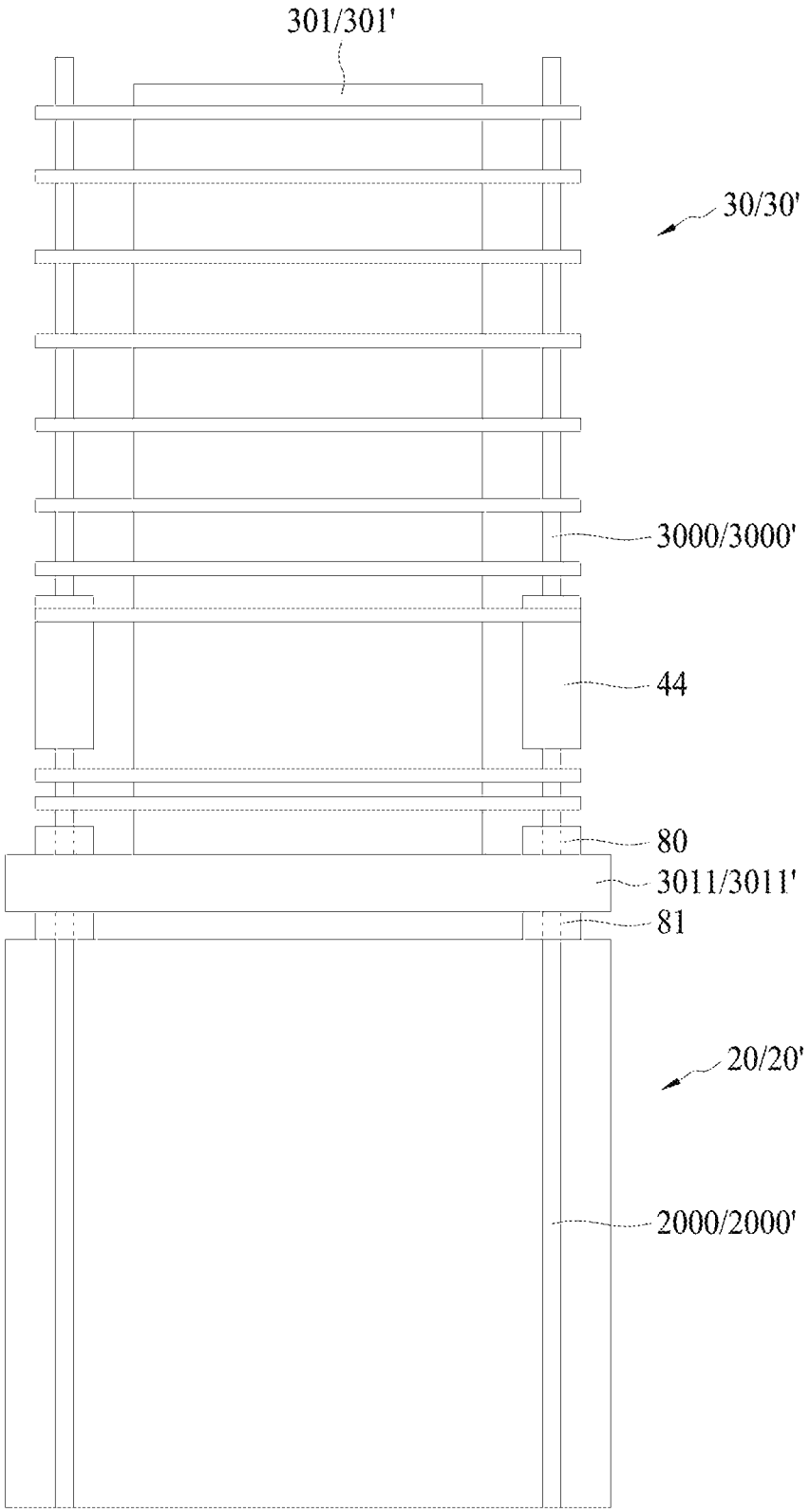
FIG. 14 is a perspective schematic view showing the connection of the second column with the third column by cylinder-type couplers.

Please refer to FIG. 14. FIG. 14 is a perspective schematic view showing connection of the second column with the third column by cylinder-type couplers 44. In this embodiment, the third column 30 (30') is not a pre-fabricated reinforced concrete column; instead, it is molded and grouted at the construction site. The connection of the second column 20 (20') and the third column 30 (30') of the first load-bearing column 1 or second load-bearing column 1' is described below.

The bottom surface of the steel column 301 (301') of the third column 30 (30') is provided with a flange 3011 (3011') which has a plurality of through holes therein so that a portion of the main reinforcements of the second main reinforcement assembly 2000 (2000') of the second column 20 (20') pass through the plurality of through holes and protrude therefrom. Further, the bolts 80, 81 are respectively provided at the top surface and the lower surface of the flange 3011 (3011') and are fitted to the protruding portion of the main reinforcements of the second column 20 (20'). The structure of the cylinder-type couplers 44 is substantially identical to that of the pipe-type couplers 40. The cylinder-type couplers 44 have internal threads (not shown) that correspond to the external threads of the protruding portion of the main reinforcements of the second main reinforcement assembly 2000 (2000') and the third main reinforcement assembly 3000 (3000') such that the third main reinforcement assembly 3000 (3000') is connected and fixed to the top of the second main reinforcement assembly 2000 (2000').

The above embodiments merely describe the principle and effects of the present disclosure, instead of limiting the present disclosure. Therefore, persons skilled in the art can make modifications to and variations of the above embodiments without departing from the spirit of the present disclosure. The scope of the present disclosure should be defined by the appended claims.

What is claimed is:

1. A load-bearing column used in a factory with waffle slabs, comprising:

a first column arranged on an underground floor, wherein the first column is a reinforced concrete column;

a second column arranged on a ground floor and fixed to a top of the first column, wherein the second column is a pre-fabricated reinforced concrete column;

a third column fixed to a top of the second column, wherein the third column comprises:

a steel column; and a third reinforcing bar assembly which surrounds a circumference of the steel column and extends from a bottom end of the steel column in an axial direction to a predetermined distance.

2. The load-bearing column according to claim 1, wherein the first column comprises a first reinforcing bar assembly which comprises a first main reinforcement assembly and a first stirrup assembly secured to the first main reinforcement assembly;

the second column comprises a second reinforcing bar assembly which comprises a second main reinforcement assembly and a second stirrup assembly secured to the second main reinforcement assembly; and the third reinforcing bar assembly of the third column comprises a third main reinforcement assembly and a third stirrup assembly secured to the third main reinforcement assembly.

3. The load-bearing column according to claim 2, wherein the first column is a pre-fabricated reinforced concrete column.

4. The load-bearing column according to claim 3, further comprising a plurality of first couplers having opposite ends one of the ends of each of the plurality of first couplers being rotatably fitted to the first main reinforcement assembly while the other end of each of the plurality of first couplers is rotatably fitted to the second main reinforcement assembly so that the second column is fixed to the first column; and a plurality of second couplers having opposite ends, one of the ends of each of the plurality of second couplers being rotatably fitted to the second main reinforcement assembly while the other end of each of the plurality of second couplers is rotatably fitted to the third main reinforcement assembly so that the third column is fixed to the second column.

5. The load-bearing column according to claim 4, wherein a bottom surface of the steel column of the third column is provided with a flange which has a plurality of through holes so that at least one portion of main reinforcements of the second main reinforcement assembly of the second column pass through the plurality of through holes and protrude from the plurality of through holes.

6. The load-bearing column according to claim 5, further comprising a plurality of third couplers which couple the at least one portion of the main reinforcements of the second main reinforcement assembly protruding from the through holes and corresponding main reinforcements of the third main reinforcement assembly wherein the plurality of third couplers have external threads at an upper end and a lower end thereof, upper ends of the main reinforcements of the second column have first sleeves embedded therein, and the first sleeves have internal threads corresponding to lower external threads of the plurality of third couplers wherein lower ends of the main reinforcements of the third column have second sleeves embedded therein and the second sleeves have internal threads corresponding to upper external threads of the plurality of third couplers.

7. The load-bearing column according to claim 6, wherein the first reinforcing bar assembly further comprises a first tie bar assembly having tie bars, each of the tie bars of the first tie bar assembly comprising a first end and a second end, wherein the first end is hooked and secured to a first main reinforcement of the first main reinforcement assembly, and the second end is hooked and secured to a second main reinforcement of the first main reinforcement assembly, and the first main reinforcement corresponds to the second main reinforcement.

8. The load-bearing column according to claim 6, wherein the first stirrup assembly is a spiral stirrup assembly, and wherein the first stirrup assembly comprises a first main spiral stirrup and a plurality of first auxiliary spiral stirrups substantially arranged outside the first main spiral stirrup, and the plurality of first auxiliary spiral stirrups partially overlap the first main spiral stirrup.

9. The load-bearing column according to claim 8, wherein the first main reinforcement assembly comprises:

a first inner main reinforcement, the first main spiral stirrup surrounding and connecting to an outer side of the first inner main reinforcement;

a first middle main reinforcement disposed between the first main spiral stirrup and one of the plurality of first auxiliary spiral stirrups; and a plurality of first outer main reinforcements disposed outside the first main spiral stirrup and inside the first auxiliary spiral stirrup.

10. The load-bearing column according to claim 6, wherein the second reinforcing bar assembly further comprises a second tie bar assembly having tie bars, each of the tie bars of the second tie bar assembly comprising a first end and a second end, wherein the first end is hooked and secured to a third main reinforcement of the second main reinforcement assembly, and the second end is hooked and secured to a fourth main reinforcement of the second main reinforcement assembly, and the third main reinforcement corresponds to the fourth main reinforcement.

11. The load-bearing column according to claim 6, wherein the second stirrup assembly is a spiral stirrup assembly, and wherein the second stirrup assembly comprises a second main spiral stirrup and a plurality of second auxiliary spiral stirrups substantially arranged outside the second main spiral stirrup, and the plurality of second auxiliary spiral stirrups partially overlap the second main spiral stirrup.

12. The load-bearing column according to claim 11, wherein the second main reinforcement assembly comprises:

a second inner main reinforcement, the second main spiral stirrup surrounding and connecting to an outer side of the second inner main reinforcement;

a second middle main reinforcement disposed between the second main spiral stirrup and the second auxiliary spiral stirrup; and a plurality of second outer main reinforcements disposed outside the second main spiral stirrup and inside the second auxiliary spiral stirrup.

13. The load-bearing column according to claim 6, wherein the third reinforcing bar assembly further comprises a plurality of third auxiliary reinforcements, each third auxiliary reinforcement being substantially located at a corner of the steel column, the third auxiliary reinforcement being substantially C-shaped with an opening toward the steel column, the third auxiliary reinforcement having a first end and a second end, the first end being hooked and secured to a fifth main reinforcement of the third main reinforcement assembly and the second end being hooked and secured to a sixth main reinforcement of the third main reinforcement assembly.

14. The load-bearing column according to claim 13, wherein the steel column is provided with a plurality of shear studs thereon for enhancing the connection between the steel column and concrete to be applied thereto.

15. The load-bearing column according to claim 6, wherein the third stirrup assembly is a spiral stirrup assembly, and wherein the third stirrup assembly comprises a third main spiral stirrup and a plurality of third auxiliary spiral stirrups substantially arranged outside the third main spiral stirrup, and the plurality of third auxiliary spiral stirrups partially overlap the third main spiral stirrup.

16. The load-bearing column according to claim 15, wherein the third main reinforcement assembly comprises:

a third inner main reinforcement, the third main spiral stirrup surrounding and connecting to the outer side of the third inner main reinforcement;

a third middle main reinforcement disposed between the third main spiral stirrup and the third auxiliary spiral stirrup; and a plurality of third outer main reinforcements disposed outside the third main spiral stirrup and inside the third auxiliary spiral stirrup.

17. The load-bearing column according to claim 16, wherein the steel column is provided with a plurality of shear studs thereon for enhancing the connection between the steel column and concrete to be applied thereto.

18. The load-bearing column according to claim 6, wherein each stirrup of the first stirrup assembly and each stirrup of the second stirrup assembly are respectively provided with a continuous strip-shaped reinforcing bar with a first end portion of the continuous strip-shaped reinforcing bar bent inwardly to form a first anchoring section, a middle portion of the continuous strip-shaped reinforcing bar being bent in a specific order to generally form a square shape, and a second end portion of the continuous strip-shaped reinforcing bar being bent inwardly to form a second anchoring section such that each of the stirrups has a peripheral stirrup, a plurality of longitudinal tie bars, a plurality of latitudinal tie bars and two anchoring sections wherein the first anchoring section is provided near a middle of a side of the square shape and the second anchoring section is provided near the middle of an adjacent side of the square shape.

19. A factory comprising a plurality of load-bearing columns according to claim 3, wherein the waffle slabs are horizontally provided between the plurality of load-bearing columns at a level around where the second column connects with the third column.

20. A factory comprising a plurality of load-bearing columns according to claim 3, wherein the waffle slabs are horizontally provided between the load-bearing columns at a level around the predetermined distance from a bottom of the third column of the plurality load-bearing columns.

21. A factory having a first load-bearing column and a second load-bearing column according to claim 3, wherein a first position is around where the second column connects with the third column of the first load-bearing column, and a second position is upward distanced from a bottom of the third column of the second load-bearing column by the predetermined distance, and waffle slabs are horizontally provided between the first position and the second position.

* * * * *